US010906081B2

(12) United States Patent
Niec et al.

(10) Patent No.: US 10,906,081 B2
(45) Date of Patent: Feb. 2, 2021

(54) SHAPED METAL CONTAINER, MICROSTRUCTURE, A METHOD FOR MAKING A SHAPED METAL CONTAINER

(71) Applicants: Philippe Niec, Sable sur Sarthe (FR); Marc Lemiale, Bazouges sur le Loir (FR); John E. Adams, Alpharetta, GA (US); Yuping Lin, Tucker, GA (US)

(72) Inventors: Philippe Niec, Sable sur Sarthe (FR); Marc Lemiale, Bazouges sur le Loir (FR); John E. Adams, Alpharetta, GA (US); Yuping Lin, Tucker, GA (US)

(73) Assignees: The Coca-Cola Company, Atlanta, GA (US); Ardagh MP Group Netherlands B.V., Deventer (NL)

( * ) Notice: Subject to any disclaimer, the term of this patent is extended or adjusted under 35 U.S.C. 154(b) by 819 days.

(21) Appl. No.: 15/027,969

(22) PCT Filed: Oct. 7, 2014

(86) PCT No.: PCT/US2014/059533
§ 371 (c)(1),
(2) Date: Apr. 7, 2016

(87) PCT Pub. No.: WO2015/054284
PCT Pub. Date: Apr. 16, 2015

(65) Prior Publication Data

US 2016/0256910 A1 Sep. 8, 2016

(30) Foreign Application Priority Data

Oct. 8, 2013 (EP) ..... 3187775

(51) Int. Cl.
*B21D 26/049* (2011.01)
*B21D 51/26* (2006.01)
(Continued)

(52) U.S. Cl.
CPC ..... *B21D 26/049* (2013.01); *B21D 51/24* (2013.01); *B21D 51/2623* (2013.01);
(Continued)

(58) Field of Classification Search
CPC .. B21D 26/049; B21D 51/24; B21D 51/2623; B21D 51/2638; B21D 51/2646;
(Continued)

(56) References Cited

U.S. PATENT DOCUMENTS 4,643,330 A * 2/1987 Kennedy ..... B65D 41/04 215/329
5,058,408 A 10/1991 Leftault, Jr. et al.
(Continued)

FOREIGN PATENT DOCUMENTS

EP 0521637 A1 1/1993
EP 0733415 A1 9/1996
(Continued)

OTHER PUBLICATIONS

International Search Report for PCT/US2014/0059533, dated Apr. 28, 2015, 2 pps.
(Continued)

*Primary Examiner* — J. Gregory Pickett
*Assistant Examiner* — Niki M Eloshway
(74) *Attorney, Agent, or Firm* — Foley & Lardner LLP

(57) ABSTRACT

The principles of the present invention further provide both a shaped metal container and its preforms that exhibit a rounded grain structure characteristic created by an annealing process and a method for making a shaped metal container. The process of making said metal container results in a quicker process time and uses less metals (at least 10% metal weight savings), thus allowing for a decrease in the costs of making such shaped metal containers. A shaped metal container may include work hardened rolled sheet-
(Continued)

A: Not annealed
B: annealed and 4% expansion
C: annealed and 18% expansion
D: annealed and after die necking metal defining a sidewall, an opening, and a base, where at least one section along the sidewall has grains with an average aspect ratio less than about 4 to 1.

13 Claims, 16 Drawing Sheets

(51) Int. Cl.
*B21D 51/24* (2006.01)
*B21D 51/40* (2006.01)
*B65D 1/02* (2006.01)

(52) U.S. Cl.
CPC ..... *B21D 51/2638* (2013.01); *B21D 51/2646* (2013.01); *B21D 51/40* (2013.01); *B65D 1/0207* (2013.01); *B65D 1/0246* (2013.01); *B65D 2501/0027* (2013.01)

(58) Field of Classification Search
CPC .... B21D 51/40; B65D 1/0207; B65D 1/0246; B65D 2501/0027
USPC ..... 215/379
See application file for complete search history.

(56) References Cited

U.S. PATENT DOCUMENTS 5,085,679 A 2/1992 Hinze et al.
5,746,080 A * 5/1998 Hartman ..... B21D 51/2646 72/342.94
5,832,766 A * 11/1998 Hartman ..... B21D 51/2646 72/62
6,250,122 B1 * 6/2001 Robinson ..... B21D 26/049 29/421.1
6,253,597 B1 * 7/2001 Hogendoorn ..... B21D 51/2615 413/69
6,349,586 B1 * 2/2002 Johnson ..... B21D 51/2615 413/69
2003/0084694 A1 5/2003 Gong et al.
2008/0253862 A1 * 10/2008 Gillest ..... B21D 19/12 413/1
2008/0302454 A1 * 12/2008 Kajihara ..... C22F 1/047 148/692
2010/0100213 A1 4/2010 Allen et al.
2011/0089182 A1 4/2011 McClung et al.
2011/0167886 A1 * 7/2011 Mallory ..... B21D 26/049 72/58
2016/0144991 A1 * 5/2016 Adams ..... B65D 1/0223 215/375
2016/0236261 A1 * 8/2016 Adams ..... B21D 51/2607

FOREIGN PATENT DOCUMENTS

EP 0864385 A2 9/1998
FR 2495507 A1 6/1982
GB 2334472 A 8/1999
JP H09253763 A 9/1997
JP H1004848 A 4/1998
WO 2013135877 A1 9/2013

OTHER PUBLICATIONS

European Examination Report corresponding to Europe Patent Application No. 14815112.9, dated Nov. 2, 2018, 8 pages.

* cited by examiner

A: Not annealed
B: annealed and 4% expansion
C: annealed and 18% expansion
D: annealed and after die necking

SHAPED METAL CONTAINER, MICROSTRUCTURE, A METHOD FOR MAKING A SHAPED METAL CONTAINER

RELATED APPLICATIONS

This application is a 371 National Stage Application of International Application No. PCT/US2014/059533, filed Oct. 7, 2014, This application which claims priority to co-pending Patent Application having Serial No. EP13187775.5 filed Oct. 8, 2013, the contents of which are incorporated herein by reference in their entirety.

FIELD OF THE INVENTION

The principles of the present invention relate to a method for making a shaped metal container, and to a microstructure thereof.

BACKGROUND

Metal containers are generally used for packing food, paint, ink, gas, liquid spray, particulate material, and beverages, such as soft drinks. The metal containers generally have a cylindrical shape. Such metal containers can be easily produced with known methods in the art, such as by (deep) Drawing and Wall Ironing (DWI).

The metal containers have generally no substantial impact on the quality and taste of the content. Handling is very convenient because the metal container generally does not break when dropped unwantedly. The strength of the metal container is usually provided by the combination of the container and its content. After emptying the metal container the metal container can easily be reduced in volume without the risk of injuries. Finally, the metal container may be recycled.

However, there is a tendency not only to produce the traditional cylindrical metal containers, but also to produce metal containers having the form of glass or plastic (PET) bottle as are presently in the market for beverages. Glass and plastic, used for making such beverage bottles, however, have properties that are very different from metal properties. Differences in properties relate to ductility and handling after heating. For instance, a glass or plastic preform may be blown directly into the required bottle shape. Such shapes are characterized in that over the axial height, the bottle may have (gradually changing) different diameters. The top section may have a smaller diameter (Dt). Towards the bottom, the diameter increases gradually in the middle section to a largest diameter (Dm). Thereafter, the diameter may decrease to a minimum, thereby forming a tailored shape. Subsequently, the diameter increases gradually towards the bottom diameter Db, which is equal to or less than the largest diameter Dm.

Another type of glass bottles are perfume bottles which vials in silhouette having attractive aesthetic shapes. Such silhouettes may be similar to a female silhouette, a football silhouette, an hour glass silhouette, and the like. As understood in the art, such shapes cannot be produced using metal as the container or vial material.

Because of the tailored shape and/or bulging shapes, such bottles containers or vials made of glass or plastic, having properties very different from metal, such as aluminum and steel, it is generally accepted that such shapes cannot be made as such from metal.

It is known to make containers, such as aerosol containers, by blow forming metal, but such method is not suitable for making shaped metal containers similar to the described shaped metal containers. There is a way to improve the cost efficiency is to make a two-piece container, with bottom and sidewall made of two-piece metals and joined together. However, for many applications, one-piece metal beverage containers having an integral bottom are preferred.

Generally, one-piece metal beverage containers are made by (deep) drawing and wall ironing (DWI) or by a Draw and Re-Draw process (DRD). These processes use a combination of ironing and deep drawing, or drawing and redrawing, to produce a pre-determined wall thickness with a smaller diameter and an increase wall height. Starting from a flat blank (in general a disk to achieve a round can), the first drawing operation create a "cup" defined by a diameter and a height. In order to respect the material formability, it is only possible to achieve the final diameter with a sequence of re-draw. All the (re)-drawing operations transform a shape (like a cup) from one diameter to another smaller diameter. The height is given by the volume of material of the original blank. The thickness of the body is about the original thickness. For a tall can, this process creates progressive thickening toward the top of the can. In such conditions, to achieve a tall can with a great ratio height/diameter, a lot of metal shaping steps are required. For DRD containers, a deep drawn container means a container made in general by a large number of re-draw steps to achieve the height/diameter ratio.

A more recent technology, used for decades in beverage industry, introduces the possibility to manage the thickness of the body. The start of the process is same as DRD, namely one draw operation (to make the cup) and at least one re-draw operation to reduce the shape diameter to the final diameter of the can. The next steps of the process only change the body wall thickness, not the diameter. These steps are defined by the motion of a punch (inside the shape) through calibrated rings. The sequence of rings allows reducing progressively the thickness of the body. This part of the process is called wall ironing. The entire process is called Draw and Wall Ironing (DWI). On top of that, the profile of the punch makes possible to get different thicknesses on the body. In general, a thin wall and a thick upper part dedicated to form a neck and seam. This DWI process has a major action on the material especially during wall ironing phase, and is an example of massive work hardening. The DRD process with the re-draw steps has a similar effect on the wall, but to a lesser extent. The drawback, however, is the work hardening. Due to the work hardening phenomenon, the hardness of the body increases significantly. For example, for some types of steel, the hardness can increase to 650 MPa or more. For aluminum, the hardness can increase up to 300-350 MPa dependent on the alloys used. This increase of hardness is accompanied by a corresponding fall in the available elongation, therefore reduced forming capability.

Ultimately, a container preform having a cylindrical body with a cylinder diameter Dc is formed. The DWI and DRD technology are generally used for manufacturing, but the drawing, redrawing and/or ironing generate work hardening of the body of the preform. The drawing and/or ironing generate(s) tensile stress in the material. The tensile stress results in a crack when a particular elongation percentage is surpassed. This work hardening results in a reduction of the elongation percentage of the preform available for further shaping, such as but not exclusively by blow forming or mechanical expansion.

Such metal container preforms may be shaped by outwardly shaping, such as by using blow forming Thereto, the container preform is positioned in a mold dictating the desired ultimate outer shape of the container. High pressure is applied to the container preform which will be blown outwardly and in contact with the inner surface of the mold. The blow forming of the preform also results in a reduction of the height of the preform.

Metal container preforms may be subjected to necking for reducing the diameter of the top section of the preform. Necking generates compression stress in the material, which results in wrinkles when a particular compression stress threshold is surpassed. A hard material is more sensitive to wrinkles because the compression stress to achieve is higher to move to the plastic domain. During necking, the free end of the preform is subjected to a number of small reductions of the diameter.

It is evident that the working of the preform increases the strength or hardness of the worked preform part. Such increase in hardness or strength is not desired because it is counter acting other types of shaping that require softer metal. This applies even more for products that have a non-circular body.

An option for having better performance in either a DWI process or a necking process could be the selection of adapted aluminum or steel alloys. However, such alloys may have other or less suitable properties and/or alloys are not generally used, which has a result on the material costs.

SUMMARY

The principles of the present invention provides both a shaped metal container and its preforms that exhibit a rounded grain structure characteristic created by an annealing process and a method for making a shaped metal container. The process of making the metal container results in a quicker process time and uses less metal (at least 10% metal weight savings) thus allowing for a decrease in the costs of making such shaped metal containers. Additionally, the current process results in a surprising and unexpected way of identifying a metal shaped container. The shaped metal container exhibits a rounded grain structure characteristic created by an annealing process. The rounded grain structure, which is defined by an aspect ratio at least in part, constitutes the basis for the improvement of the properties and represents a "fingerprint" for determining whether the shaped metal container (or its preforms) was subjected to annealing after work hardening. In one embodiment, the annealing process may be performed at a higher temperature than typical heating of work hardened metal, such as work hardened rolled metal (e.g., 3000 series aluminum, and in particular, 3104 series aluminum alloy), which metal in non-annealed form is used for forming metal containers (e.g., beverage containers). In an alternative embodiment, the annealing process may be performed at an annealing temperature at or slightly higher (e.g., within 5° C.) than a recrystallization threshold temperature or solid-state solution threshold temperature.

In one embodiment, a method for making a shaped metal container, may include a container middle section having at least one middle section diameter Dm, which container middle section is connected at one end to a container bottom section having at least one bottom section diameter Db, and at the other end connected to a container top section having a container opening, and having at least one top section diameter Dt by: (i) providing a container preform having a cylindrical body with a diameter Dc, (ii) inwardly shaping by necking at least a section of the cylindrical body, and (iii) outwardly shaping at least a section of the cylindrical body, where at least a section to be inwardly or outwardly shaped is annealed such that at least one of the middle section diameter Dm, the bottom section diameter Db, and the top section diameter Dt is greater than, and at least one of the middle section diameter Dm, the bottom section diameter Db and the top section diameter Dt, is smaller than the cylinder diameter Dc of the container preform.

The principles of the present invention is based on the insight, which by making use of an annealing step carried out on a container preform, the yield strength is reduced, and ductility increased, whereby the metal of the container preform becomes softer, and allows for more elongation before failure. In the annealing step, the metal of the preform may be subjected to an elevated temperature generally in the range of 150-450° C., such as 200-400° C. and 200-350° C. (preferred range 200° C. to 450° C., more preferred range 250° C. to about 400° C., most preferable range 315° C. to about 385° C.) that alters the material property yield strength, ductility and elongation at break, whereby the material becomes more workable. The annealing is carried out at a suitable temperature during a suitable period of time for acquiring the desired reduction in yield strength and improvement in ductility and elongation at break or failure. The time is dependent on the technology for imparting the product with the annealing temperature. The faster the annealing temperature is reached, the shorter the annealing period of time, which may be useful in high volume production rate processes.

Generally, for aluminum, the temperature is in the range of 200° C.-400° C., for so-called high temperature annealing, the annealing temperature is higher, such as 350° C.-454° C. for a period of time of 1 μsec to 1 hour, such as 0.1 sec to 30 min, 1 sec to 5 minutes, or 10 sec to 1 minute. For steel, the annealing temperature range is normally much higher and may be for instance 500° C.-950° C. and the period of time may be for instance of 1 μsec to 1 hour, such as 0.1 sec to 30 min, 1 sec to 5 minutes, or 10 sec to 1 minute. It is evident that dependent on the work hardened aluminum alloy used and the thickness of the material, the temperature and period of elevated annealing may be adjusted. Such adjustments, however, are within the skills of the person skilled in the art. The annealing may be carried out in an oven in which the container preform is present for a sufficient period of time in order to acquire the desired reduction in yield strength or increase in ductility and elongation.

The annealing treatment results in a reduction of the hardness, a reduction of the yield strength, and an increase of ductility. Moreover, as a microstructure of a cylindrical metal preform changes during an annealing process that heats the metal preform to temperatures higher than typical heating processes as described herein below, grains of the annealed sections of the metal container are changed from having high average aspect ratios (e.g., greater than about 5) from rolled work hardened sheet-metal to having short average aspect ratios of less than about 4 to 1, and preferably less than 3.5 to 1, more preferably less than about 3 to 1, most preferably less than about 2.5 to 1, or most preferred less than about 2.0 to 1, because of recovery, recrystallization and possible grain growth.

In the oven, and in one embodiment, the entire container preform is annealed so that the yield strength of the container preform is decreased, the ductility increased, and the percent elongation-to-break increased over the entire height. Such a change in properties is not always desired when in a subsequent making step for the shaped metal container, a shaping step is carried out at a axial force, with an axial load that cannot be withstood by other sections of the container preform that are less strong, and, therefore, would collapse or irregularities, such as wrinkles, buckles and/or pleats, are formed.

Accordingly, the principles of the present invention provide as an option that at least one sub-section is annealed, whereas other sections are not annealed and maintain the original material properties. Such sectional annealing is possible by induction annealing or other localized heating techniques.

In an induction annealing treatment, the relevant section of the container preform is subjected to electromagnetic induction generating within the metal so called Joule heat of the metal. For such electromagnetic induction heating, an induction heater is used that includes an electro magnet through which a high-frequency alternating current is passed. Obviously, the conditions for the induction heating are dependent on the size of the container preform, on contact and distance to the induction heater, and/or the penetration depth. In the case of using induction heating on work hardened rolled sheet metal (e.g., aluminum and its alloys), such as 3000 series aluminum, such as 3104 series aluminum, time for heating the work hardened rolled sheet metal to above a recrystallization threshold temperature to cause the aspect ratio of the grains of metal to be reduced to less than about 4, less than about 3.5, less than about 3, less than about 2.5, or less than about 2, may be less than 5 seconds. In contrast to induction heating, a box oven or other air heating technique may take five minutes or less to raise the temperature of the metal so as to cause the aspect ratio of the grains of metal to be reduced to less than about 4, less than about 3.5, less than about 3, less than about 2.5, or less than about 2. Time of maintaining the temperature above the recrystallization threshold level for either of the heating processes may vary based on the thickness of the metal and specific composition of the metal, but is easily ascertainable by one skilled in the art. A temperature to be reached to cause the aspect ratios in a shorter period of time that may be used for mass production of metal containers formed by work hardened rolled aluminum and its alloys may be higher, such as between about 315° C. and 450° C., and between about 325° C. and 350° C., and at or about 350° C. for a time duration between about 0.1 second to about 1 minute, for example. Cooling of the annealed metal preform may be performed in ambient temperature, such as room temperature.

In the subsequent shaping step, the shaping is the result of a plastic (permanent) deformation and not of an elastic deformation. Due to the annealing treatment, the material may be elongated to an extent of about 10% to 20%, dependent on the type of material and material alloy, such as 3000 series, like 3104H19. Since the annealing treatment results in an increase of elongation, it is evident that the annealing treatment has a beneficial effect on outwardly shaping, which is generally based on a material elongation. The beneficial effects of the annealing treatment is based on the conversion of the flat, "pancake" work hardened grain structure having an elongated average aspect ratio (e.g., greater than about 5) into a rounded grain structure having a shortened average aspect ratio (e.g., less than about 4 to 1, and preferably less than 3.5 to 1, more preferably less than about 3 to 1, most preferably less than about 2.5 to 1, or ideally less than about 2.0 to 1), which is more symmetrical and multidirectional in properties, and has less stresses and with significantly enhanced formability.

In relation to the sections of the container preform that could be subjected to an annealing treatment, it is evident that when the container middle section is to acquire a larger diameter than the container preform by outwardly shaping, such as by blow forming, then the middle section is subjected to the annealing treatment. The container bottom section may not be subjected to an annealing treatment because the bottom is the thickest section of the container preform, which thickness is substantially equal to the thickness of the disk shaped blank. The transition from the bottom to the cylindrical body is generally less strong due to the change in thickness, the curved shape, and its location, so annealing of this transitional area is generally not required. In relation to the container top section, which is generally to be subjected to a necking, or inward shaping, annealing is not required or only to a limited extent. When annealed, the subsequent necking operation can be performed on hard material. The use of annealing to reduce yield strength can help to reduce a number of die necking steps in the multi-die necking, which reduces complexity and cost of forming metal containers. Although blow forming and die necking are presented herein to shape a metal container from an annealed metal preform, it should be understood that any other metal shaping technologies, such as pressure forming, hydro forming, mechanical, and/or non-mechanical metal shaping technologies, may be utilized in accordance with the principles of the present invention. Because of the rounded grains of the metal, the metal preform formed of work hardened aluminum and its alloys may be reshaped at room temperature to expansion level than previously considered possible. However, when the necked container top section is to be provided with a thread and/or a circumferential bead, then annealing is generally utilized as a thread and/or circumferential bend is more easily formed on metal with reduced stress. Since the extent of annealing may be different between the container middle section and the container top section, induction annealing may be utilized so that each of the sections is annealed to a different extent, as desired.

When the container preform is to be provided with a lacquer and/or a printing, the annealing treatment is performed prior to the subsequent lacquering and/or printing treatment. Accordingly, annealing is avoided after applying lacquer and/or print to the container preform as high temperature annealing generally has a negative effect on the lacquer and/or print.

The outwardly shaping may be carried out with various different mechanical and non-mechanical techniques, such as mechanical expansion or stretch, but blow forming may be used because of the high quality of the outwardly shaping. In addition, it is possible, when desired, to impart the outer surface of the blow formed wall with strengthening or aesthetic structures extending inwardly and/or outwardly. Such structures are frequently present in the body wall of glass container or bottle for beverages, such as soft drinks.

The outwardly shaping by necking results in an axial load on the container preform. Such axial load may amount to about 1000N-1800N, and more preferably to about 1300N-1600N which is generally an axial load too large to withstand by the foot of the preform for the blow formed preform. When a top section that is too soft is subjected to the necking operation, formation of undesired wrinkles results. This could be overcome by the selection of another metal temper, or an increased number of necking dies used or change in the thickness of the container top section. In one embodiment according to the present invention, it is preferred to carry out under such circumstances the necking operation on a container preform or a blow formed container preform with the preform accommodated and supported, particularly at its sections or parts having a lower strength and susceptible to collapse the axial load, by a supporting sleeve.

Often, the shaped metal container is to be provided at its opening with a thread unto which a screw cap may be screwed for closing the shaped metal container. It is generally preferred after filling the metal container, to apply the cap while applying an axial capping force. The cap is mounted on the thread and over the opening. For such capping, but also for a traditional handling of the metal container before and during filling and later transport, the necked container top section may be provided with a so called cap bead.

It will be apparent to the skilled person, that the formation of this cap bead and/or the thread reduce the strength of the necked container top section, so that this container top section may have an insufficient strength for withstanding the axial load. Accordingly, the principles of the present invention provide a solution to this problem in the form of at least one axial interruption provided in the circumferential bead and/or in the thread. This interruption in the bead restores part of the original shape and therefore increases the axial strength. For an increase of the axial strength over the circumference of the container top section, two, three or more axial interruptions may be spaced apart over the circumference of the cap bead. Similarly, such axial interruptions may also be provided in the thread of the container top section, where the axial interruptions may be spaced apart over the circumference as long as the axial interruptions do not interfere with the screwing action of the cap. The application of these axial interruptions increases the axial strength such that the axial load to be applied during the capping operation is generally withstood without collapse of the container top section.

After the annealing of the preform in particular the cap middle section, resulting in a softer middle section wall, the transition to the bottom is less soft and becomes stronger with the increase of the thickness towards the bottom. Accordingly, this transitional section between the container middle section and container bottom section may be difficult to outwardly shape by blow forming. Accordingly, the ultimate shape of the foot of the bottom section may not be as desired. This problem in relation to the difficulty of blow forming the transition between the container middle section and the container bottom section may be overcome by applying an axial compression onto the container metal preform during the blow forming. Applying an axial compression results in a larger flow of material outwardly, but also more in the direction of the bottom and the foot, and thereby to a better formation of the desired shape of in particular the transition part for the foot part.

After necking or outwardly shaping, the free ends of the opening may be trimmed and curled. Trimming is generally required for providing a shaped metal container with the specified (height) dimensions. Curling of the free end not only improves the aesthetic appearance, but also provides a smooth surface for sealing, and when the consumer intends to drink with the mouth directly from the shaped metal container. Obviously, such curling of the free end results in some material loss, as will be the result of the trimming operation.

The shaped metal container may be a one-piece container, such as a metal beverage bottle. Such bottle is generally characterized by a container bottom section having a diameter Db that is generally greater than or equal to the diameter Dc of the cylindrical part of the preform, the container middle section may have a first diameter Dm1 larger than or equal to Dc, and a second diameter Dm2 equal or smaller than the diameter Dm1 but larger or equal to the diameter Dc, and the container top section is smaller than the diameter Dc. Accordingly, this metal beverage bottle is formed by annealing the preform followed by blow forming and thereafter necking, or formed by necking followed by blow forming. The necking operation reduces the diameter below the diameter Dc of the preform, whereas blow forming increased the diameter beyond the diameter Dc of the preform. The container may have gradually changing diameters between the various container sections, which are greater, equal and/or smaller than Dc.

Another aspect of the principles of the present invention relates to a shaped metal container of which at least a section has been subjected to annealing, whereby the annealed section acquires a rounded grain structure, as defined by an average aspect ratio being shortened below about 4.0. The annealed section becomes more multidirectional in properties because of the acquired rounded grain structure through recovery reduction in stress in metal and recrystallization morphology grain structure changes from elongated to more rounded shape. It is noted that the grain is no longer elongated as initially provided from a rolled, work hardened sheet metal, and although still non-uniform in nature, typically has an average aspect ratio in cross-section (of the largest diameter over the smallest diameter) that is in the range of less than about 4 to 1 (i.e., 4), less than about 3.5, less than about 3, less than about 2.5, or less than about 2. As a result of the annealing treatment, the hard worked elongated or flat "pancake"-like grain form has a large average aspect ratio (e.g., greater than 7), converts towards an rounded grain shape (e.g., less than about 4 or less than about 2), thereby decreasing hardness and increasing elongation of the metal. Subsequent blow forming and die necking result of a metal preform in an increase in hardness and strength of the metal.

Another aspect of the principles of the present invention relates to a preform for a shaped metal container, where the preform or a preform section has a rounded grain structure with an aspect ratio in the range of less than about 4, less than about 3.5, less than 3, less than about 2.5, or less than about 2.

Another aspect of the principles of the present invention relates to a shaped metal container, such as a one-piece or two-piece container, having a container middle section connected at one end to a container bottom section, and at the other end to a top section. At least part of the container top section, the container middle section and/or the container bottom section, being shaped by necking and another part shaped by outwardly shaping, such that at least one of the middle section diameter Dm, the bottom section diameter Db, and the top section diameter Dt is greater than, and at least one of the middle section diameter Dm, the bottom section diameter Db and the top section diameter Dt is smaller than the cylinder diameter Dc of the container preform from which container preform the shaped metal container has been made. The diameters may gradually change between the container sections.

As indicated here and before, the necked container top section is often provided with a thread and/or a bead provided with at least one axial interruption. For obtaining a metal beverage bottle, one embodiment of the container middle section is outwardly shaped, and the diameter Dm is greater than the diameter Dc, and the bottom section may be outwardly shaped with the diameter Db greater than the diameter Dc.

Finally, for mimicking closely a glass bottle, such as a glass beverage bottle, the container top section, container middle section and/or container bottom section may be provided with inwardly and/or outwardly extending strengthening of aesthetic structures.

The aforementioned and other features and characteristics of the method for making a shaped metal container and of the shaped metal container according to the invention will be appreciated from the following description of several embodiments of the method and shaped metal container according to the invention although the invention is not restricted thereto.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION OF THE DRAWINGS

Figure 1A:
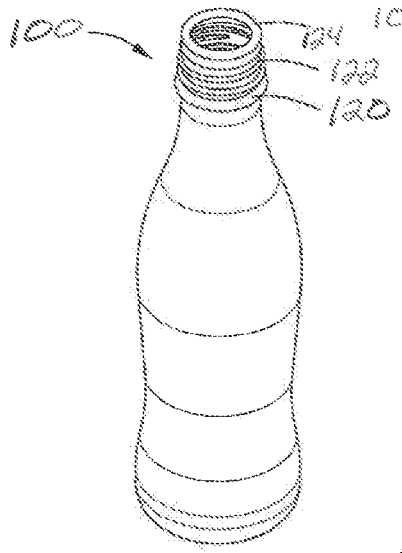
FIGS. 1A-1D are illustrations including perspective views, (FIGS. 1A and 1B) a side view (FIG. 1C), and a cross-sectional view (FIG. 1D) of an illustrative shaped metal container that may be formed utilizing the principles of the present invention.
Figure 1B:
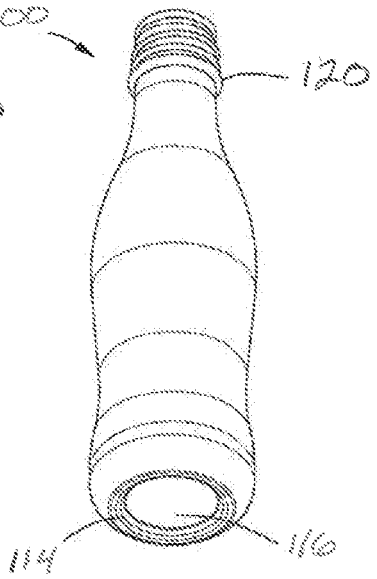
Figure 1C:
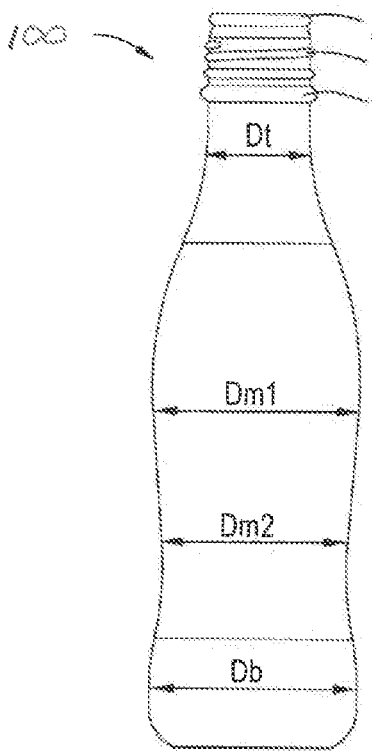
Figure 1D:
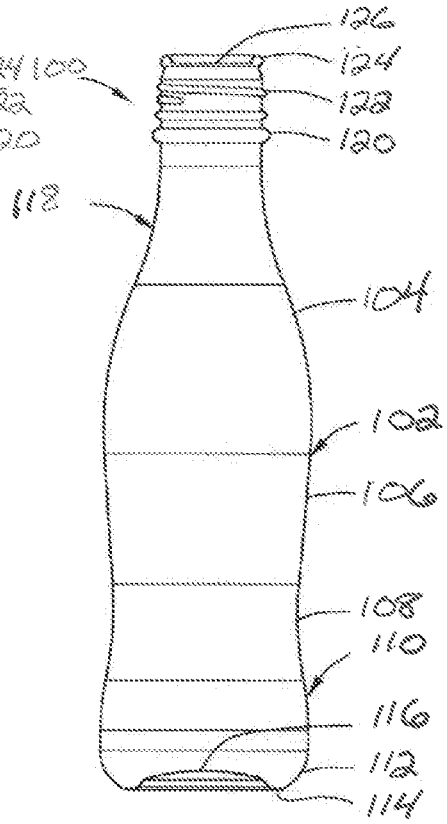

FIGS. 1A-1D are illustrations of a shaped metal container 100 that may be formed utilizing the principles of the present invention. The shaped metal container 100 is a one-piece beverage container having an integral bottom. The container 100 includes a container middle section 102 defined by middle section parts 104, 106, and 108. The container middle section 102 is connected at one end to a container bottom section 110 including a transitional section 112, a foot 114, and a central dome section 116. At the other end, the container middle section 102 is connected to a container top section 118 including a bead 120, a thread 122, and an inwardly curled end 124 defining a container opening 126. The shaped metal container 100 may include a bottom section having a diameter Db of, for instance, 53 mm. In one embodiment, the container middle section 102 may have a largest diameter Dm1 of 53 mm, and a smaller diameter Dm2 of 47 mm. The container top section 118 may have a top section diameter Dt of 25 mm. The height of the shaped container 100 is, for instance, 185 to 190 mm. It is apparent from FIG. 1C that the diameter of the shaped metal container 100 may gradually change in between the various identified diameters. The body wall of the shaped metal container 100 may have a thickness of 0.14 to 0.20 mm, such as 0.175 mm. The gauge of the original material may be about 0.30 to about 0.40 mm, such as 0.35 mm, which is substantially the thickness of the dome section 116. The content of the shaped metal container 100 may be from 250 to 280, such as 270 ml. It should be understood that shaped metal containers with smaller or greater dimensions and/or volume are also possible.

Figure 2A:
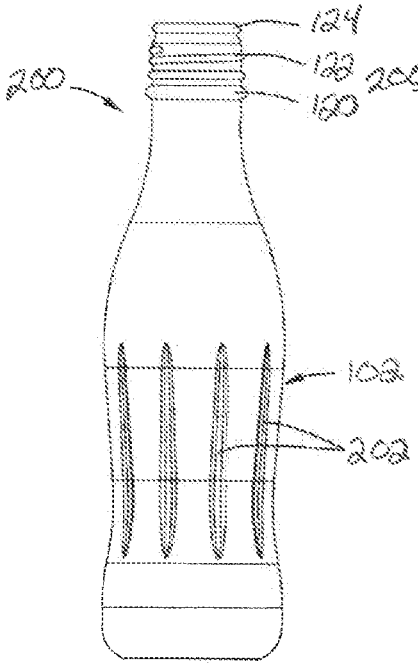
FIGS. 2A and 2B are illustrations of a side view and cross-sectional view of another illustrative shaped container including inwardly extending structures that may be formed utilizing the principles of the present invention.
Figure 2B:
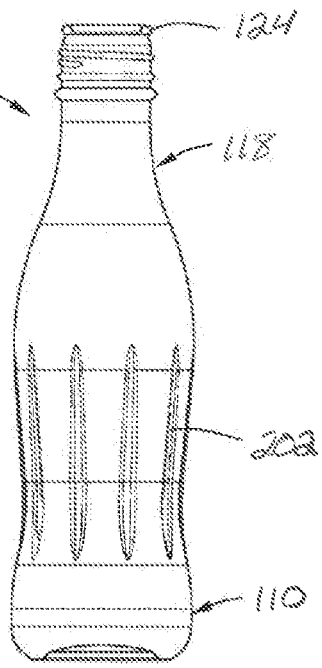

FIGS. 2A and 2B are illustrations that show an alternative shaped metal container 200 in side view and cross sectional view, respectively. The same structural features as in FIG. 1, are identified by the same reference numbers. The container middle section 102 is provided with axially extending and inwardly extending structures or flutes 202. These flutes 202 provide more strength into the container middle section 102 and/or may also provide the shaped metal container 200 with an improved aesthetic appearance. The flutes 202 may additionally and/or alternatively extend in a non-axial direction.

Figure 3A:
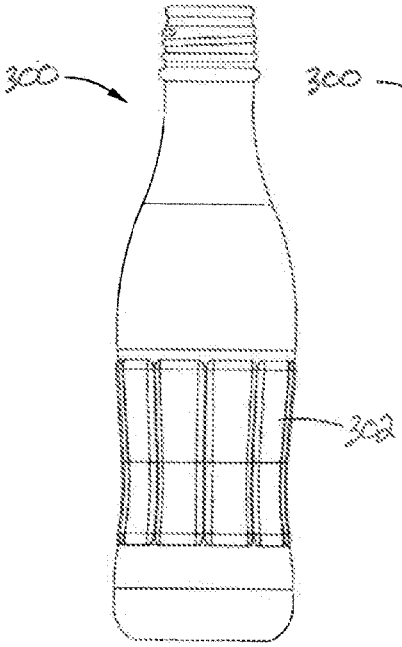
FIGS. 3A-3C are illustrations of another illustrative shaped container in side view, cross-sectional view and a droplet magnification, respectively, and with outwardly extending structure.
Figure 3B:
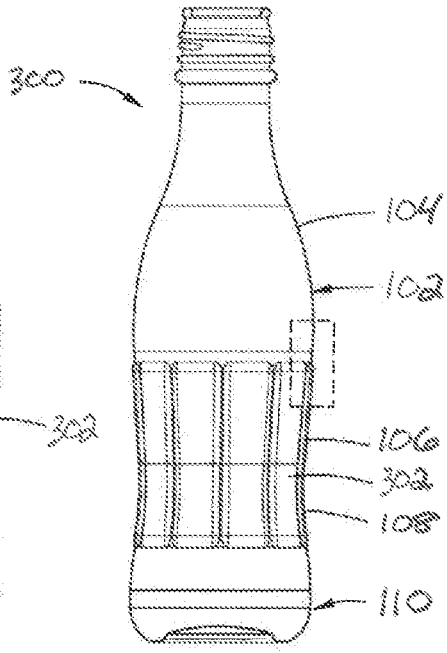
Figure 3C:
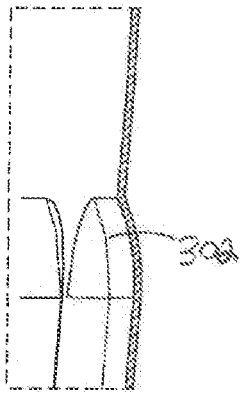

FIGS. 3A-3C are illustrations that show an alternative shaped metal container 300 in side view, cross-sectional view and a droplet magnification, respectively. Again, the same structural features are identified by the same reference numbers. The container middle section 102, and in particular the middle section parts 106 and 108 are provided with outwardly extending structures or flowers 302. The flowers 302 extend outwardly and may be equally spaced apart over the circumference of the container middle section 102. These structures 302 provide strength and/or a desired aesthetic to the shaped metal container 300, and may extend non-axially.

The skilled person will appreciate that the structures 202 and 302 may also be incorporated in the other sections of a shaped metal container according to the principles of the present invention, and may be present in one and the same shaped metal container. The structures 202 and 302 may also be configured to provide the appearance of a logo of the company that has filled or will fill its content into the shaped metal container. In addition to such logo, imprints may also be applied to the outer surface of the shaped metal container.

Figures 4A, 4B, 4C, 4D, 4E:
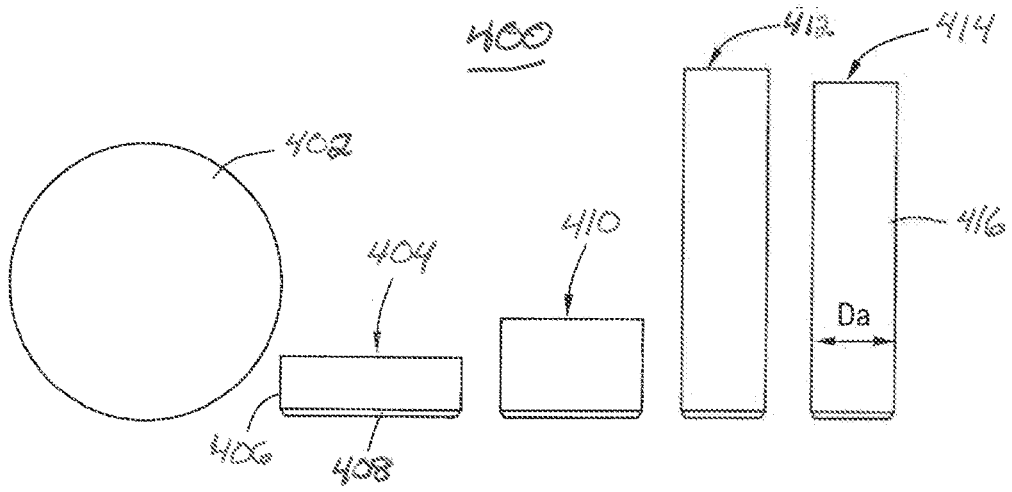
FIGS. 4A-4K are illustrations of an illustrative metallic bottle progressively formed at each step of an illustrative process for making a shaped metal container utilizing the principles of the present invention.

FIGS. 4A-4K (collectively FIG. 4) are illustrations of a shaped metal bottle being formed at each step of a process 400 for making the shaped metal container shown in either FIG. 2 or 3. The process starts with a circular disc shaped blank 402 in FIG. 4A that is formed into a cup 404 in FIG. 4B including cylindrical wall 406 and a bottom 408 (see FIGS. 1A and 1B). The thickness of the cylindrical wall is slightly less than the thickness of the blank 402, but the thickness of the bottom 408 is substantially the same as the thickness of the blank 402. By drawing and ironing, cups 410 and 412 in FIGS. 4C and 4D, respectively, are formed with progressively smaller diameter and increased height (FIGS. 3C and 3D). The cup 412 is then trimmed, resulting in preform 414, as shown in FIG. 4E. The preform 414 has a cylindrical body 416 with a diameter Dc, see FIG. 4E. The thickness of the preform 414 is generally within the range of 0.10 to 0.40 mm, such as 0.14 and 0.26 mm, such as 0.16 to 0.24 mm. This preform 414 is subjected to an annealing treatment, as described further herein, of its entire height in an oven (not shown). The annealing may result in a yield strength for the preform 414 within the range of about 250 to 650 MPa, such as 270 to 630 MPa, such as 280 to 600 MPa. The ultimate yield strength to be acquired by the annealing treatment is further dependent on the metal and/or thickness of the cylindrical wall of the preform 414. The annealed preform 414 is subjected to an outwardly shaping of the cylindrical body 416 to the preform 418 shown in FIG. 4F.

Figures 4F, 4G, 4H, 4I, 4J:
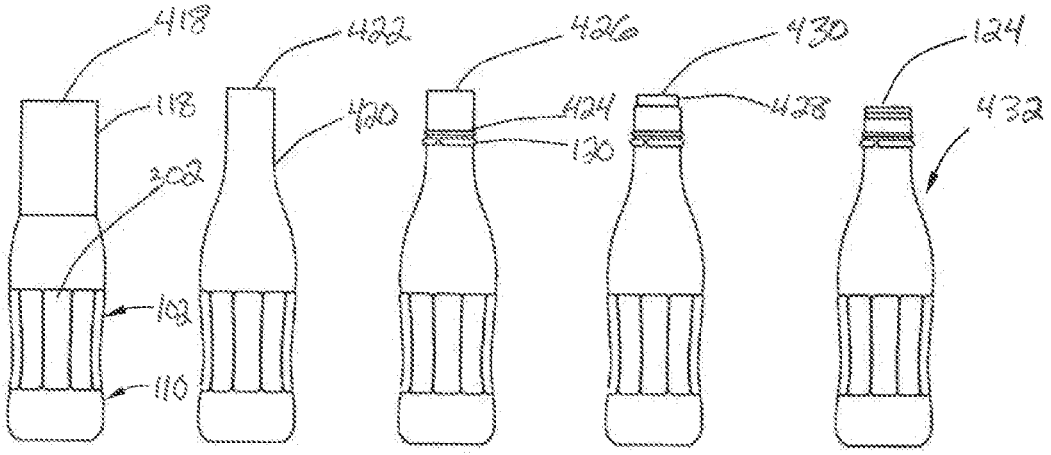

The container middle section 102, container bottom section 110 and the container top section 118 all have been subjected to a blow forming shaping, whereas in the container middle section 102, the structures 18 have been formed. The blow formed preform 418 may then subjected to an inwardly shaping by necking of the top section 420 of the blow formed container shown in FIG. 4G. After carrying out a necking procedure in multiple necking rings, such as 1 to 40 necking rings, such as 1 to 30 necking rings, preferably 1-20 necking rings, dependent on the wall thickness, the hardness and the yield strength of in particular the blow formed top section 420 is increased. The resulting blow formed and necked preform 422 is then subjected to a beading operation for forming the beads 120 and 424, as shown in FIG. 4H. The formed preform 426 is subjected to a further necking operation for forming a necked outer section 428 by using 1-10 necking rings, such as 1-5 necking rings, as shown in FIG. 4I. The preform 430 obtained is then subjected to a curling operation for curling the necked section 428, as shown in FIG. 4I. The preform 432 of FIG. 4J is finally subjected to a threading operation for forming the thread 122, thereby forming the shaped metal container 200, for example.

Figure 4K:
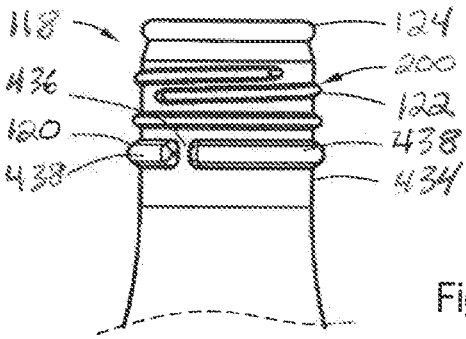

The enlarged view of the container top section 118 as shown in FIG. 4K shows that the bead 120 is not continuous over the circumference of the neck 434 of the shaped metal container 200, but may be interrupted over its circumference, thereby forming axial interruptions 436 in between the bead parts 438, which increases the axial strength of the neck 434. In one embodiment, the bead 120 is not continuous over the circumference of the neck of the shaped metal container 200, but may be interrupted over its circumference, thereby forming axial interruptions in between the bead parts, which increases the axial strength of the neck. The neck thereby acquires an axial strength withstanding an axial load of more than 1100N, such as 1200 to 1300N. Without the presence of these bead interruptions, the top load resistance would have been only about 1000N. It is noted that within the concept of the invention it is also possible to first carry out the necking step as illustrated by FIG. 4G, and thereafter the blowing step illustrated by FIG. 4F.

Figures 5A, 5B, 5C, 5D, 5E:
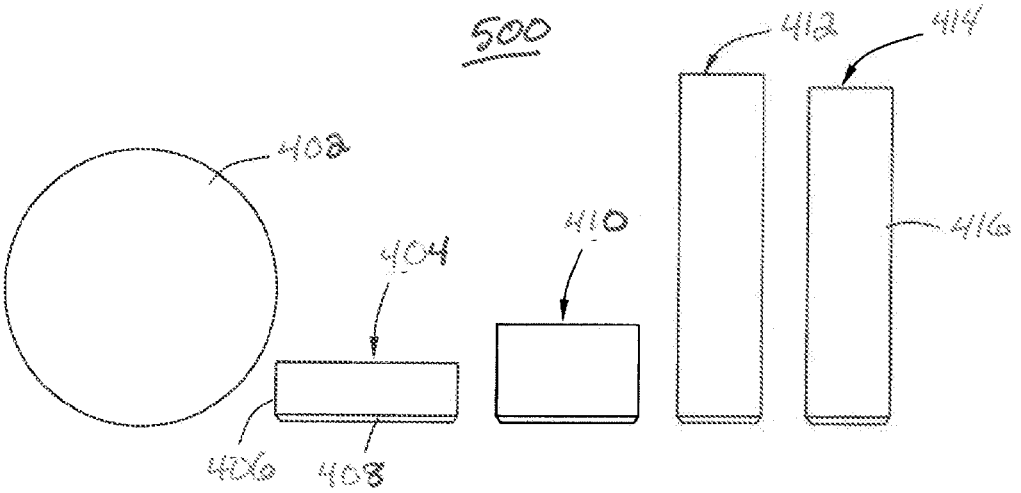
FIGS. 5A-5K are illustrations of an illustrative metallic bottle being progressively formed at each step utilizing an alternative process for making a shaped metal container.
Figures 5F, 5G, 5H, 5I, 5J:
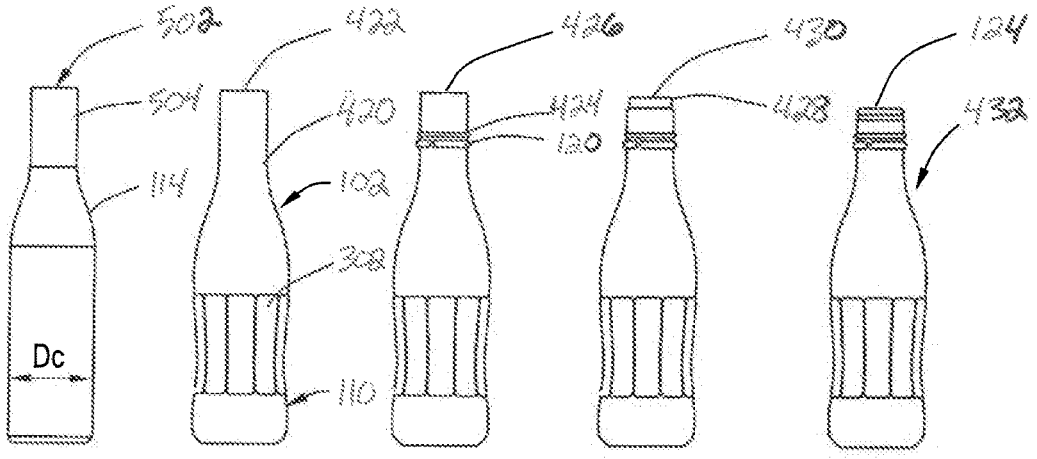

FIGS. 5A-5K are illustrations of a shaped metal bottle being progressively formed at each step of process 500 utilizing an alternative method according to the principles of the present invention for making a shaped metal container 200. The same reference numbers are used for identifying the same structural features as disclosed and described in relation to FIGS. 4A-4K. The difference in the method of making the shaped container 200 is that the preform 414 of FIG. 5E is not subjected after the annealing treatment to a blow forming operation, but the preform 414 is subjected to a necking operation as was used in the method according to FIG. 4 to the blow formed preform 418. The preform 414 is subjected to a necking operation using necking rings in a number of 1-30, such as 1-25 or 1-20 necking rings, as illustrated in FIG. 5F. The preform 502 includes a neck container top section 504 that is connected to the middle section part 114 of which the diameter gradually increases to the diameter Dc of the cylindrical wall or body 416. Subsequently, the container middle section 102 of the preform 502 may be subjected to an annealing procedure, as further described herein, by induction annealing, for example, whereby the yield strength is decreased, and the ductility and elongation-to-break increased. After the annealing treatment, the preform 502 is subjected to a blow forming operation of the container middle section 102 and part of the container bottom section 110, as illustrated by FIG. 5G. It is noted that within the concept of the invention that it is also possible to first carry out the necking step, as illustrated by FIG. 5G, and thereafter the blowing step, as illustrated by FIG. 5F.

Produced by the process 500 is essentially the same preform 422 as produced in the method 400 according to the principles of the present invention illustrated in FIG. 4.

Figure 5K:
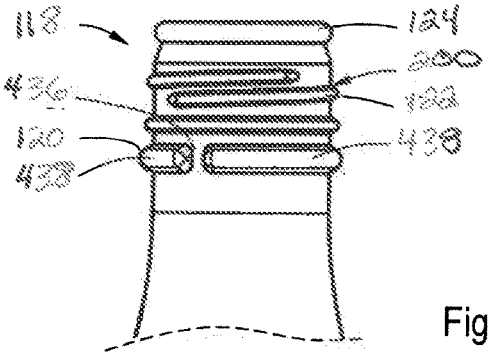

Hereafter, the preforms 426, 430, and 432 are produced as shown in FIGS. 5H-5J, and ultimately is formed the shaped metal container 200 of which detail is shown in FIG. 5K.

The shaped metal container may be formed from aluminum or steel from suitable alloys and/or tempers.

Generally, the blank 420 may have a diameter of 100-150 mm, such as 125 to 135 mm and a thickness that may be of 0.30 to 0.60 mm, such as 0.40 to 0.50 mm. The cups 404-412 may have a diameter of 80-100 mm, 60-70 mm and 40-50 mm, respectively. The preform 414 may have a diameter of 40 to 50 mm, such as 45 mm, for producing the shaped metal container 100 or 200, as described in FIGS. 1, 2, and 3. These dimensions are dependent on the dimensions of the ultimate shaped metal container, and can be selected by the skilled person.

FIGS. 6A-6D are illustrations that show more in detail the outwardly shaping of the preform 414 by blow forming. However, it is noted that other mechanical techniques, such as mechanical expansion or stretching may also be used. With the blow molding variant, it is also possible to provide the shaped metal container with strengthening and/or ornamental structures, and, if desired, customer logos.

Figure 6D:
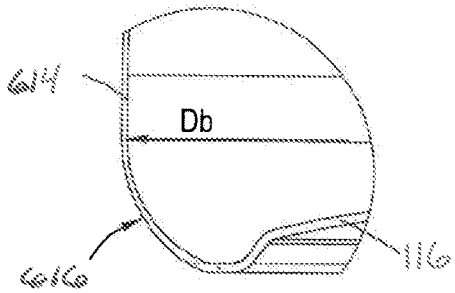
FIGS. 6A-6D show a blow forming of a shaped metal container with FIGS. 6C and 6D being illustrations that depict droplet magnifications of the transitional section between sidewall and foot.
Figure 6A:
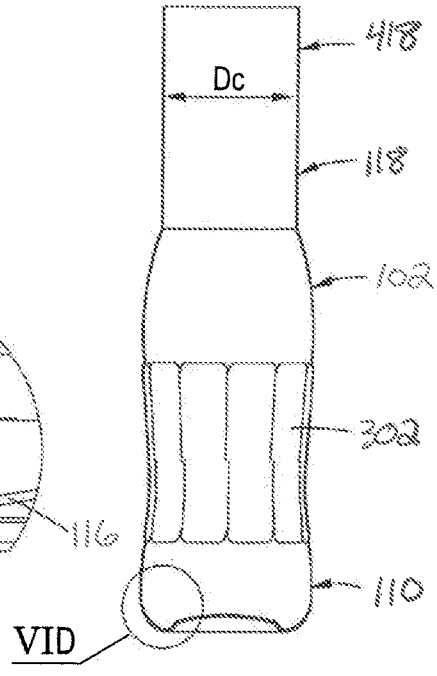

FIG. 6A is an illustration that shows preform 418 after blow forming. The preform 418 includes a substantially cylindrical container top section 118 of which the diameter is substantially the same to the diameter Dc of the cylindrical body 416 of the preform 414. For instance, the cylindrical diameter Dc may be 45 mm. The container middle section 102 and part of the container bottom section 110 has also been subjected to the blow forming operation. Resulting in a diameter Dm1 of for instance 53 mm, a diameter Dm2 of 47 mm and a diameter Db of 53 mm, see also FIG. 1C and FIG. 6D.

Figure 6C:
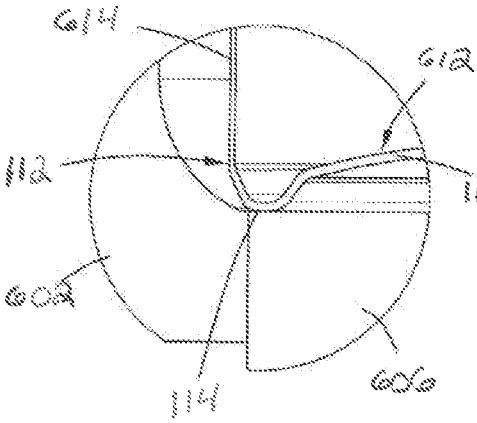
Figure 6B:
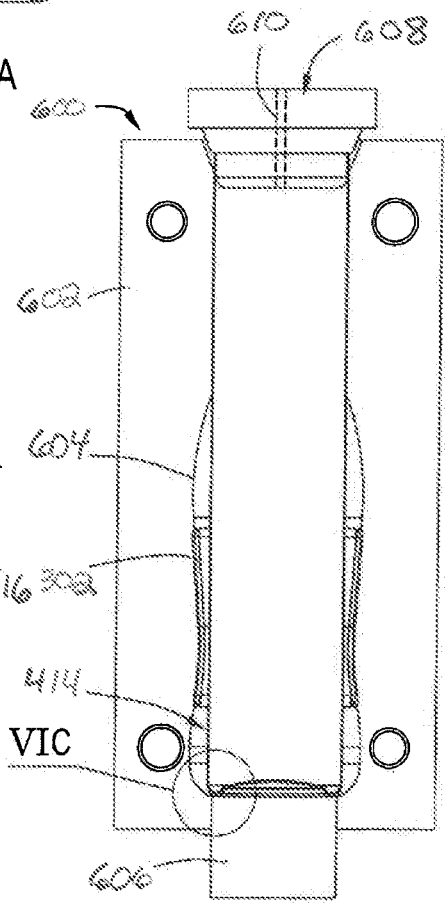
Figure 7A:
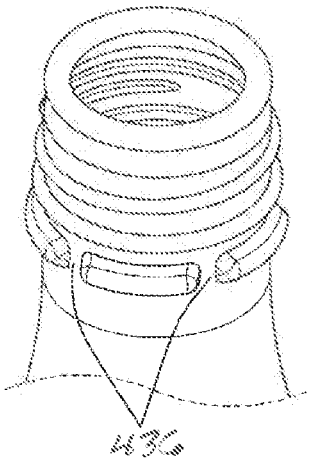
FIGS. 7A-7D are illustrations of perspective views, side view and cross-sectional view, respectively of a necked container top section with bead according to the principles of the present invention.
Figure 7B:
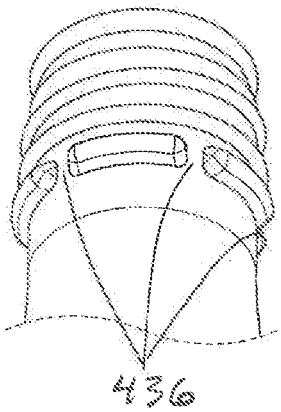
Figure 7C:
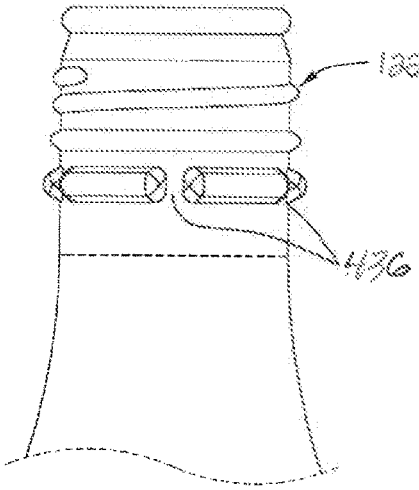
Figure 7D:
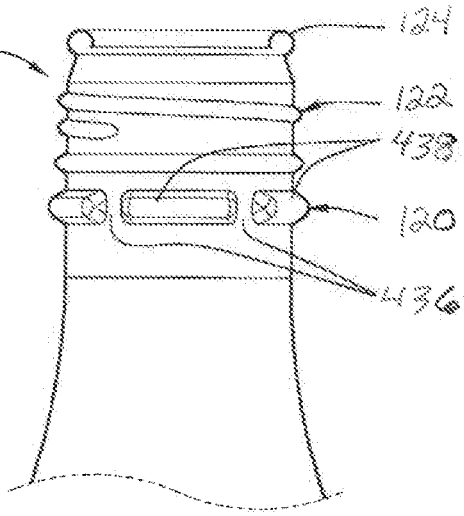

FIG. 6B is an illustration that shows blow forming unit 600 including two separable mold parts 602 having an inner surface 604 corresponding with the outer shape of the blow formed container middle section 102 and container bottom section 110 as shown in FIG. 6A. The inner surface 604 also includes the surface details dictating the formation of the structures 302. The preform 414 is mounted in the blow forming unit 600 resting on a support 606 dictating the shape of the dome section, and a mold plug 608 is inserted into the preform 414. It is noted that in an alternative form, a mold cap can be used that is pressed on the free end of the preform 414 or extends and is clamped to the outside of the upper part of the preform 414. An airtight connection may be formed with the preform 414 to perform a blow process utilizing the principles of the present invention. The mold plug 608 is provided with an air inlet 610, so that the preform 414 may be subjected to high pressure, such as 30-50 bar, such as 40 bar. The high pressure blow may result in a blow forming of the preform 418 to the extent that is allowed by the mold, and, in particular, the mold parts 602.

As shown by the droplet magnification of FIG. 6C, a bottom profile 612 may be formed by defining the dome section 116, the foot 114, the transitional section 112, and the body wall 614.

Instead of a cylindrical body wall 418, it is possible to provide the foot 114 with an outward bulging transitional section 616 as shown in FIG. 6D. Thereto, it is advisable that with the mold plug 610, a compression load is performed on the preform 414 during the blow forming operation.

In addition, and as discussed above, it is beneficial that at least the container middle section 102 and the bottom section 110 have been subjected to the annealing treatment, thereby reducing the yield strength and increased ductility and elongation to failure. The axial load applied may be in the order of 1000 to 1800N, such as 1200-1700N, such as 1600N.

As shown in FIG. 6D, the thickness of the bottom 116 is substantially of the same thickness as the thickness of the blank 402 and may be in the order of 0.30 to 0.60 mm, such as 0.40 to 0.50 mm, such as 0.45 mm. The thickness of the body wall 614 is substantially less, and may be in the range of 0.15 to 0.25 mm, such as 0.20 mm.

The elongation-to-break of, in particular, the container middle section and bottom section may be about 10% to 25%, such as 15% to 20%, such as 18%. Such elongations are possible due to the prior annealing treatment, as described further herein, and the selection of the proper thickness and preferably the alloy and/or temper used. Obviously, these selections can be made by the skilled person and will also be dependent on the selection and type of work hardened Al metal, such as aluminum and steel. A suitable alloy, for example, is the aluminum alloy 3104-H19.

Work-hardened metal, such as aluminum or steel, and its alloys is a term known to one skilled in the art as the strengthening of a metal by plastic deformation. It is further understood that work hardened aluminum alloy will also result in the presence of greater residual stresses and the high dislocation density in the metal. The residual stresses and dislocation density can lead to higher strength and reduced elongation.

The term "rounded" used herein when describing annealed grain structure means any type of shape (i.e., geometric or non-geometric) that includes space both inside lines defining the shape and the lines of the shape.

FIGS. 7A-7D are illustrations that show a perspective view, a side view, and a cross-sectional view of the container top section 118 of a shaped metal container according to the principles of the present invention. The container top section 118 is provided with a bead 120 that includes bead parts 438 interrupted by interruptions 436 that are equally spaced apart over the bead circumference. As discussed hereinbefore, the provision of the interruptions 436 increases the axial resistance from about 800 to 1200N, to about 1200 to 1600N, such as 1300-1400N. Such increase in axial resistance is beneficial for customers using the shaped metal containers during filling and capping of the shaped metal container while the container is handled and supported at the bead 120. During capping, an axial load may be exerted on the container top section 118 that is withstood by the bead 120, as previously described.

Figure 8A:
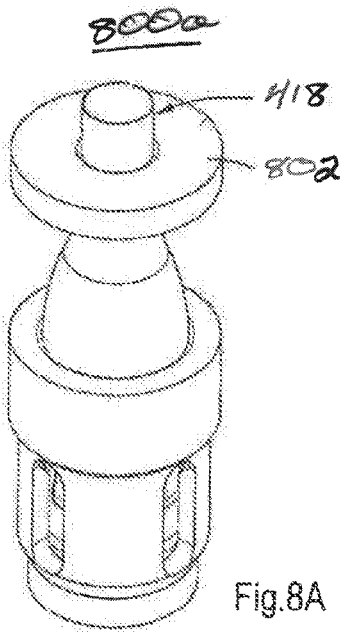
FIGS. 8A-8C are illustrations that show inward shaping by necking in the method of making a shaped metal container using a supporting sleeve.
Figure 8B:
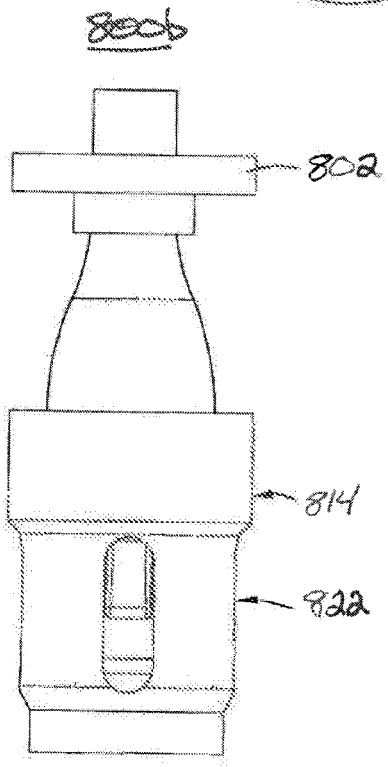
Figure 8C:
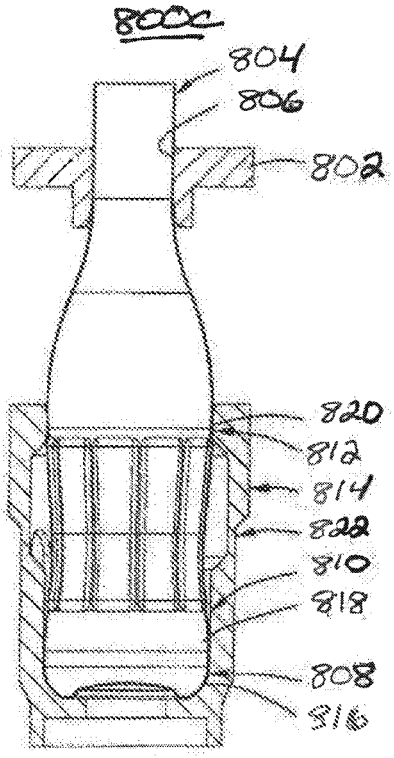

FIGS. 8A-8C are illustrations that show an illustrative necking operation 800*a*-800*c* (collectively 800), of the preform 418 thereby transformed in the preform 422 provided with the necked container top section. During the necking operation, a necking ring 802 is pushed over the container top section 804, with the diameter of the necking ring opening being slightly less than the outer diameter of the container top section 804. The necking operation 800*a* results in a small decrease of the outer diameter of the container top section 804. By repeatedly performing such necking operation with necking rings of gradually smaller ring opening diameters, the container top section 804 acquires ultimately the desired outer diameter 806, such as a diameter in the range of about 20-40 mm, such as 25 mm. As stated hereinbefore, the necking ring 802 exerts and axial load on the preform, which load is in the order of 700N-1200N, such as 1000N. This load may be too large for relatively weak parts of the preform, such as the transitional section 808 near the foot of the shaped metal container, the lower part of the container middle section 810 and near the maximum diameter in the upper part of the container middle section 812. Still, the necking operation may be carried out without failure of the preform during the necking operation, and thereto the principles of the present invention provide a supporting sleeve 814 that supports the preform, and contacts the preform with contact surfaces 816-820 located at or near the weaker sections of the preform. Obviously, the support sleeve 814 may also be used for handling transporting the preform and later shaped metal and thereto the support sleeve 814 may be provided with a related outer handling structure 822.

Figure 9A:
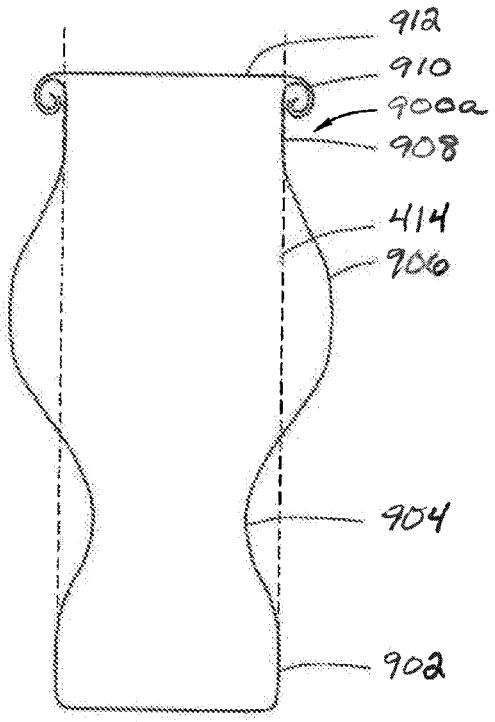
FIGS. 9A-9C are illustrations of illustrative alternative shaped metal containers according to the principles of the present invention.
Figure 9B:
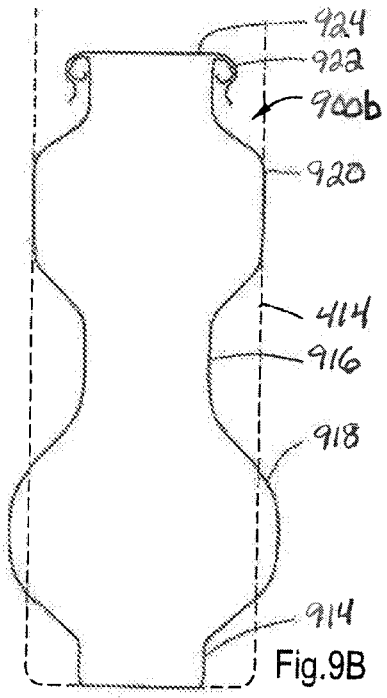
Figure 9C:
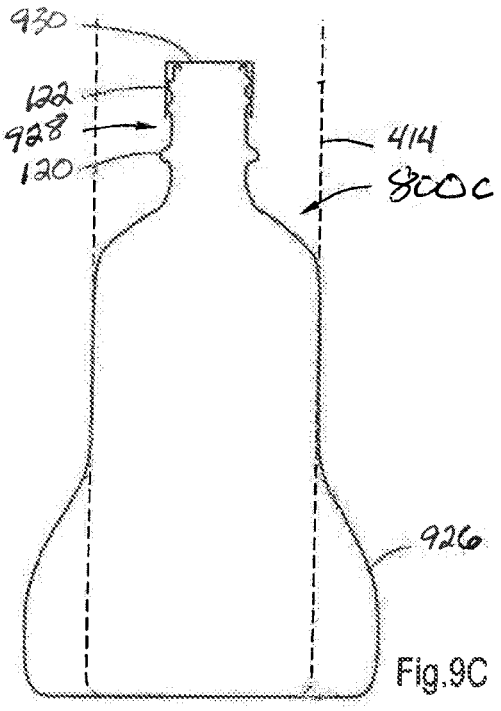

FIGS. 9A-9C are illustrations that show alternative forms for a shaped metal container 900*a*-900*c* utilizing the principles of the present invention.

FIG. 9A is an illustration of another illustrative metal shaped container 900*a* including a container bottom section 902 having a diameter equal to the diameter of the preform 414. A lower part 904 of the container has middle section in diameter smaller than the preform 414, and thereto the preform 414 was subjected to a necking operation extending up to the bottom section 902. Thereafter, the neck portion is subjected (after annealing) to a blow forming operation, thereby providing a profile as shown in FIG. 9A for the outwardly bulging part 906 of the container middle section. The container top section 908 has the same diameter as the preform 414 and is provided with a curl 910 to which is seamed a closure 912.

A shaped metal container 900*b* according to FIG. 9B has a bottom section 914 and an upper part 916 of the container middle section having a diameter smaller than the diameter of the preform 414. This diameter may, for instance, be as small as 23 mm. The lower part 918 of the container middle section has a diameter larger than the preform 414, whereas the upper part 920 has a diameter equal to the preform 414. The container 900*b* may be produced by first necking the preform 414 over its entire height, and thereafter annealing at least the parts 918 and 920 that are then subjected to the blow forming operation, thereby providing the container 900*b* with the form as shown in FIG. 9B. The top end section is again provided with a curl 922 onto which is snapped a cap 924.

FIG. 9C is an illustration of yet another illustrative shaped metal container 900*c* of which bottom section 926 is subjected to a blow forming operation, and neck section 928 is subjected to a necking operation and thereafter provided with bead 120 and a thread 122 onto which a screw cap 930 may be screwed.

Figure 10:
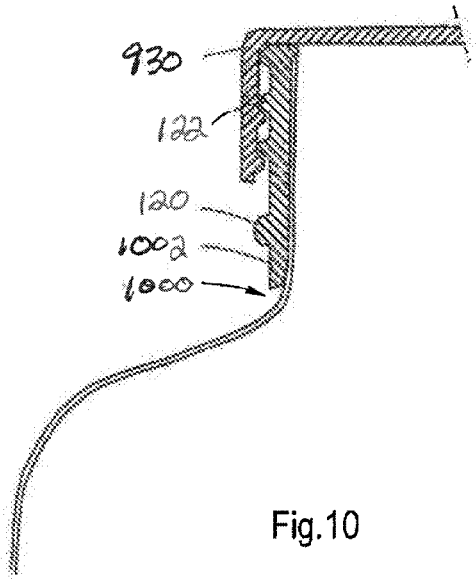
FIG. 10 is an illustration an alternative embodiment for an illustrative finish of a shaped metal container of FIG. 9C.

FIG. 10 is an illustration that shows an alternative embodiment for the neck 1028. A neck portion 1000 is provided with a metal or plastic sleeve 1002 carrying at its outside the bead 120 and the thread 122. The cap 1030 is screwed on the thread 122. Accordingly, it is possible within the subject of the invention that the necked part of the shaped metal container is provided with a sleeve attached to the container top section and provided with the thread 122, or the bead 120 or with both.

Figure 11:
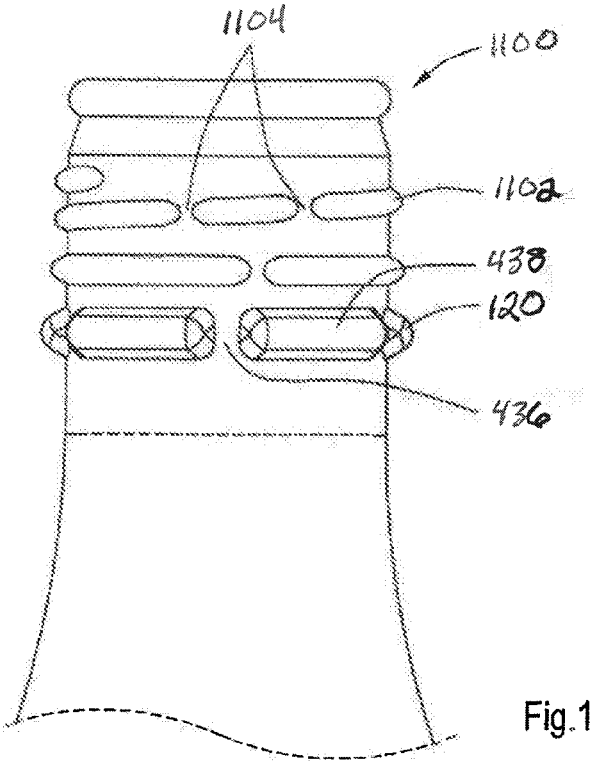
FIG. 11 is an illustration of an alternative for container top section of a shaped metal container according to the principles of the present invention.

FIG. 11 is an illustration that shows an alternative embodiment of a neck portion 1100 in which the bead 120 is provided with the interrupted bead part 438 and the interruptions 436. At the same time, the thread 1102 is provided with thread interruptions 1104 also adding to the axial resistance of the neck portion 1100.

Figure 12A:
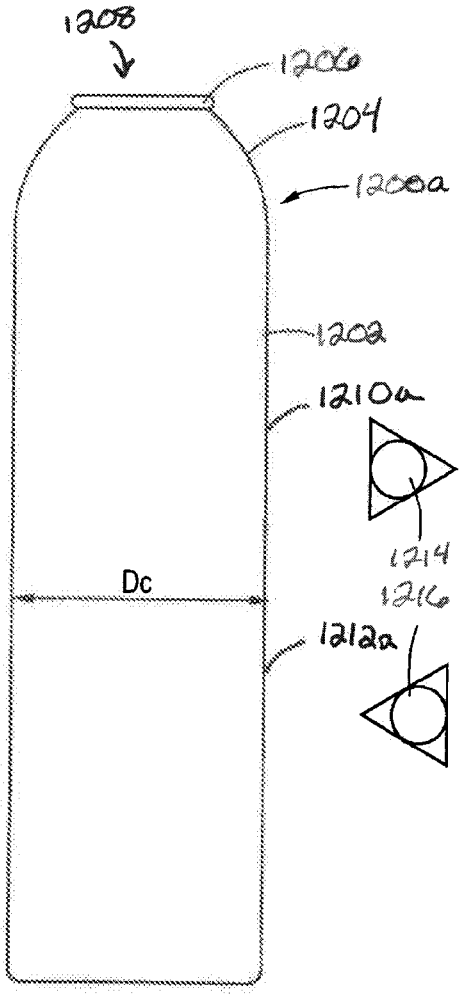
FIGS. 12A and 12B are illustrations of a side view of a preform and shaped aerosol container.
Figure 12B:
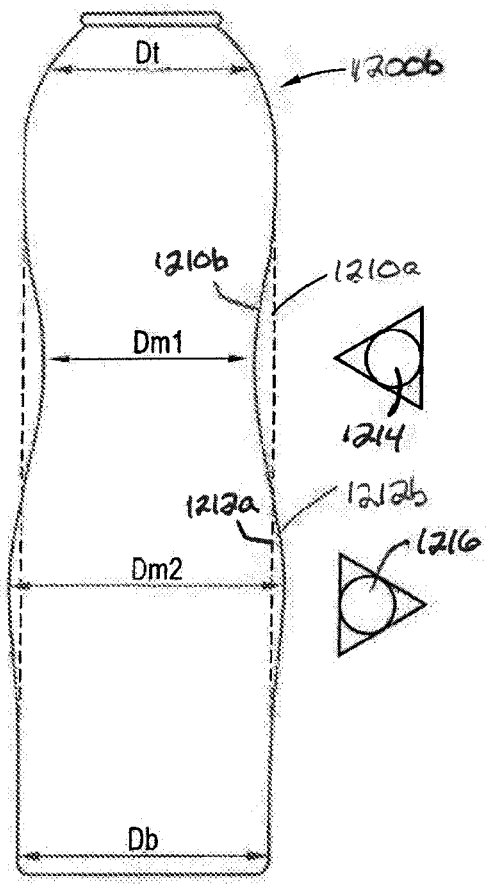

FIG. 12A is an illustration of an illustrative preform 1200*a* for an end product, such as beverage container, a carbonated beverage container, or an aerosol container, by utilizing the processes described herein. The preform 1200*a* may have a cylindrical body 1202 with a cylindrical diameter Dc, and a necked upper portion 1204 having a diameter Dt, and with a curl 1206 defining an opening 1208 of the preform 1200*a*. The preform 1200*a* is subjected to an annealing treatment in the upper middle section 1210*a* and lower middle section 1212*a* of the cylindrical body 1202. The annealing treatments may be carried out at the same time or sequentially in any order. When the annealing treatments are carried out at different temperatures and/or during different time periods, then a low annealing temperature treatment may be performed prior to a high annealing temperature treatment. The use of an induction annealing process enables short periods of time of annealing, thereby increasing production rates.

The annealed upper middle section 1210*a*, as shown, is subjected to an inwardly shaping illustrated by arrow 1214, which may be carried out by inward necking or other suitable technique. From the inward necking process, an inwardly shaped upper middle section 1210*b* results.

The annealed lower middle section 1212*a* is subjected to outward shaping by any suitable technique illustrated by arrows 1216, such as blow forming or mechanical shaping to cause an outwardly shaped lower middle section 1212*b* to be created. The end product 1200*b* is tailored having at the same time and inwardly shaped section with diameter D1*m*, and outwardly shaped section with diameter D2*m*, which are both different from the original diameter Dc.

In accordance with the principles of the present invention, a shaped metal container, such as an aluminum bottle configured is to be lightweight such that shipping and packaging costs may be reduced. Such a lightweight shaped metal container may be reduced. Such a lightweight shaped metal container may be reduced to less than 20 grams, and as low as about 17 grams or lower. The lightweight shaped metal container is to be strong enough to endure shipping and consumer use environments. To achieve such results, annealing, blow forming and multi-die necking processes (see FIG. 13) are utilized in conjunction with conventional metal container processes to achieve a novel grain structure of the metal container.

Figure 13:
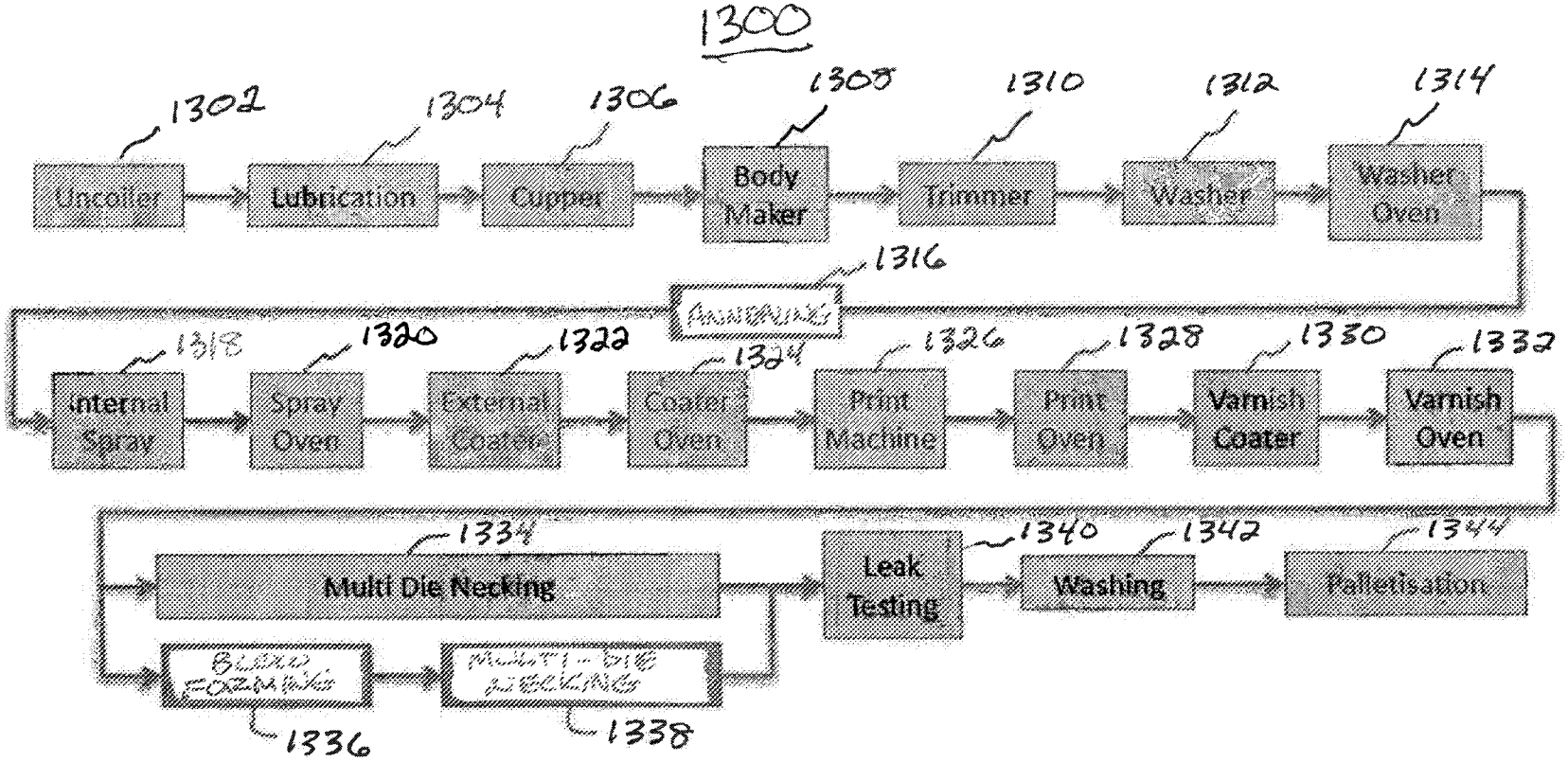
FIG. 13 is a flow diagram of an illustrative process for producing shaped metal vessels in accordance with the principles of the present invention.

With regard to FIG. 13, a flow diagram of an illustrative process 1300 for producing shaped metal vessels in accordance with the principles of the present invention is shown. The process 1300 may start at step 1302, where an uncoiler is utilized to uncoil rolled sheet metal from a roll. As understood in the art, rolled sheet metal is work hardened during the rolling process, such that grains of metal are elongated to have aspect ratios that are typically greater than 5.0, and often 7.0 and higher. Moreover, the grains appear to be stacked like "pancakes" and in an orderly arrangement, as further shown in FIGS. 13A-13B. In operation, the uncoilers holds a sheet metal coil vertically, and feeds a strip of the rolled sheet metal into first forming operations, including a lubrication step 1304 and a cupper step 1306, which may use a cutting tool to form a "blank" (see FIG. 5A) and reshaping tool that draws the blank to form a cup (see FIG. 5B). In one embodiment, multiple cupper steps may be utilized to produce an elongated cup (see FIG. 5C). The cup may have an initial height formed by the cupping tool. During the cup forming operation, very little material thinning occurs. In the event of having multiple cupping operations at step 1306, an additional draw of the initial cup occurs, whereby height of the cup is increased. In one embodiment, additional lubricant may not be used in the second cupping operation. As a result of a second cupping operation, thickness of the walls may be reduced slightly, typically on the order of less than 1/10 of a millimeter.

At step 1308, a body maker step may be configured to significantly elongate the cup formed by the cupper step 1306. The body maker step 1308 may include a wall ironing stage that uses ironing rings that progressively reduce sidewall thickness, while at the same time, significantly increase tensile properties. As an example, the sidewalls of the cup may be thinned from 0.60 mm to around 0.15 mm. Additionally, a base dome profile may also be formed in the body maker, which is conventional practice for making cans. Resulting from the body maker is an extended cylindrical preform (see FIG. 5D). At step 1310, a trimmer process may be used to trim the cylindrical metal preform so that the sidewalls have a substantially similar height along the circumference of the cylindrical preform.

The cylindrical metal preform may be washed and dried at steps 1312 and 1314. In drying the cylindrical metal preform, a washer oven may heat the cylindrical metal preform to less than about 200° C. In being about a certain temperature, the temperature may be a few degrees higher or lower than the certain temperature and be within an appropriate temperature range in accordance with the principles of the present invention. It should be understood that other temperatures may be utilized to dry the cylindrical metal preform, but that the temperatures used do not exceed a temperature that would alter the structural composition (e.g., grains) of the metal, such as by annealing to reduce tensile strength. By washing and drying the cylindrical metal preform, lubricant and dirt are removed from the surface so as to ensure that the metal surface is suitable for coating application and adhesion processes.

In accordance with the principles of the present invention, an annealing step 1316 is utilized to anneal a portion of or an entire cylindrical metal preform. Contrary to conventional heating, annealing heats a portion of or the entire cylindrical metal preform (i) to temperatures that exceed typical heating processes for rolled sheet metal used for beverage and/or aerosol containers. Moreover, as a result of the annealing process described herein, further processing and fabrication of a "useable" container from a fully annealed preform may be performed.

As a result of the significantly altered grain structure from the increased heated cylindrical metal preform is the ability to perform blow molding at room temperature to produce larger expansion than possible with lower or no annealing having been performed. As an example, blow molding of the rolled sheet metal with little or lower temperature annealing at room temperature results in a maximum expansion of about 8%, and generally below 3%, whereas it has been realized after annealing that an increase expansion of the cylindrical metal preform of upwards of or over 18% can be achieved at room temperature. As an example, one high-pressure blow may expand a 45 mm diameter cylinder to a 53.0 mm diameter cylinder in a single blow operation at room temperature. The annealing may be performed in the number of different ways, including (1) full body annealing using a recirculating air box oven, (2) full body annealing using a single station induction unit, and (3) localized annealing using a single station induction unit. It should be understood that additional and/or alternative annealing processes may be utilized in accordance with the principles of the present invention. Moreover, at least one section along the sidewall may have grains with an average aspect ratio less than about 4 to 1, where the section(s) along the sidewall is a horizontal section along a particular height of the sidewall that extends around the sidewall. In one embodiment, grains on opposing sides of the section(s) along the sidewall have an average aspect ratio higher than the average aspect ratio of the section(s) along the sidewall.

As previously described, rolled sheet metal is work hardened and has a highly organized grain structure with elongated grains (e.g., aspect ratio greater than 7) as a result of stretching the metal when forming the sheet. TABLE I shows a few data points of the average aspect ratio for the rolled sheet metal that undergoes the annealing process, as described herein.

TABLE I

Status versus Average Aspect Ratio

| Status | Average Aspect Ratio |
|---|---|
| Before Annealing (work hardened rolled sheet metal) | 7.03 |
| After Annealing | 1.48 |
| 4% Expansion | 1.54 |
| 18% Expansion | 1.71 |
| After Die Necking | 1.36 |

Continuing with FIG. 13, an internal spray operation may be performed at step 1318, where the annealed cylindrical metal preform receives an internal spray coating along with the spray being cured in a spray oven at step 1320. Temperature of the spray oven is in the range of about 200° C. The cylindrical metal preformed may also be externally coated by an external coater at step 1322, and the external coat may be cured in a coater oven at step 1324. At step 1326, the preform may be decorated by printing, as understood in the art, and the ink may be cured in a print oven at step 1328. At step 1330, a varnish coater may be used to apply a varnish to protect the decorations, and the varnish may be cured by a varnish oven at step 1332. Again, temperatures of the ovens are typically in the range of about 200° C.

As it is conventionally performed on metal bottles used for consumer goods, a multi die necking process 1334 is performed. As understood in the art, the conventional multi-die necking process 1334 may include upwards of 50 or more steps depending on the configuration of the metal container. In the event of the metal container appearing in a bottle shape, a higher number of die necking operations are utilized to provide for a smooth transition along a neck of the metal bottle. However, the use of die necking can be used to either increase or decrease a diameter of the metal container, so the multi-die necking operation 1334 is generally used to form a body shape and/or a neck of a metal bottle. Because die necking is a complex and time consuming operation, the more die necking steps that can be eliminated, the faster manufacturing of bottles can occur with a reduction in loss due to errors in the die necking processes.

In accordance with the principles of the present invention, rather than simply performing the multi-die necking operation 1334, a blow forming operation 1336 and multi-die necking operation 1338 may be performed on the annealed cylindrical metal preform. The blow forming operation 1336 may be performed at 40 Bar or higher using high-pressure air or other medium. Again, the blow forming operation 1336 may be performed at room temperature and produce a significantly expanded container due to the annealing performed at step 1316, as previously described. As a result of performing the blow forming operation at step 1336 and multi-die necking operation at step 1338, the metal may be work hardened, whereby the grains of the metal may be stretched to have a higher aspect ratio than that after being annealed, as previously described, along with having increases in tensile strength in the neck area following successive die necking operations. By expanding and contracting annealed cylindrical metal preform, the metal is work hardened and the aspect ratio of the grains may increase and decrease, respectively (see TABLE I).

Following the multi-die necking at step 1338, a leak testing step 1340, washing step 1342, and palletization step 1344 may be performed. Once palletized, the shaped metal containers may be provided to a filling line to fill the metal containers with a product, such as a soft drink. Although the annealing 1316 is shown to be performed prior to decoration of the shaped metal container, decoration technology that is capable of being heated to temperatures of 300° C. or higher may enable the annealing 1316 to be performed at a different position within the process 1300.

As a broad generalization, steps 1302-1314 define a process for forming the cylindrical metal preform, steps 1318-1332 define a decoration process, steps 1336 and 1338 define a reshaping of the cylindrical metal preform into a shaped metal container, and steps 1340-1344 define a post-metal container shaping process including inspection, cleaning, and packaging.

As previously described, the annealing and blow forming/multi-die necking steps 1316 and 1336 enable the ability to produce shaped metal containers that have heretofore been unable to be produced due to limited expansion capabilities of rolled sheet metal for use in consumer packaging, such as soft drinks and carbonated beverages. With the inclusion of the annealing and blow forming/multi-die necking steps 1316 and 1336/1338, non-symmetrically shaped containers may be produced using a single blow at room temperature making lighter weight metal packages.

As a result of utilizing the principles of the present invention, a number of features and/or results are provided that are not otherwise available through use of a conventional multi-die necking approach, including:

(1) A smaller diameter preform may be used, which reduces a finished shaped metal vessel weight, and also benefits downstream processes by eliminating metal shaping processing steps that would have to be performed or simplifying the metal shaping processing.

(2) The annealing of the cylindrical preform may recrystallize the work hardened "pancake"-like grains of the rolled sheet metal, which eliminates built-in stresses that are inherently part of the rolled sheet metal. Such elimination of the built-in stresses considerably increases ductility and, thus, formability. As an example, in the case of using 3014 H19 alloy, an increase in elongation extends from less than 3% (after wall ironing) to about 18%.

(3) The use of the blow forming between the shaping and decoration steps enables the annealed cylindrical metal preforms to be shaped in ways that would be impossible by multi-die necking alone. For example, the blow forming stage allows inclusion of flutes, surface patterning, embossing, etc., to be included in the overall design without having to perform additional necking processes. These flutes and the other patterns may provide for work hardening at those locations, which provide structural support for the shaped metal vessel.

(4) Because the blow molding process is frictionless, the vast majority of the elongation generated by the annealing process may be used in body shaping.

(5) A combination of annealing and blow forming means that a large number of multi-die necking stages are significantly reduced, and mechanical expansion stages may be eliminated.

(6) An entire lower body of the shape metal container can be formed in a single operation without inducing any work hardening or stresses in the neck area.

(7) A potentially more robust and less complex production process may be achieved, and a number of multi-die necking stages may be reduced significantly (e.g., 40 or more multi-die necking stages for producing a particular shaped metal container may be reduced to about 20 multi-die necking stages).

(8) A reduction in the number of neck forming stages may be reduced, which necessarily reduces the number of trimming and lubrication stages plus the associated equipment for trimming and lubricating.

(9) A significant reduction of risk of splits during curl formation of a lip of the shape metal vessel may results from recrystallization of the finish area of the metal container.

(10) Quick shape change-overs on a production line may be possible if the shaped differences are limited to an area of the sheet metal vessel formed by the blow forming or other metal shaping processes.

The effect of annealing and blow forming on hardness and grain structure of various sections of preforms achieve results previously not possible. Preforms made with the process of FIG. 13 and FIGS. 4A-4F, for example, provide for lightweight shaped metal containers described herein. It should be understood that other embodiments of the methods according to the principles of the present invention may be used in the alternative. The preform 414 was produced from the blank 402 made of aluminum alloy 3104-H19. The blank 402 had a thickness of 0.2 mm. The preform 414 was subjected to full body annealing in a box oven set at 350° C. for about one minute (total time in the box oven is 3 minutes), or use of an induction coil to heat metal of the preform to 350° C. for 1-2 seconds.

Annealed test shells were subjected to a tensile test (L0: 49.3 mm, 3 mm/min, at 20° C.), according to NF EN ISO 6892-1 method A. The annealed test shell had the following tensile strength characteristics:

| | |
|---|---|
| Average Rm | 192 MPa |
| Average Rp0.2 | 90 MPa |
| Average Elongation | 20.1% |

Rm: the tensile strength Rm indicates the limit at which the metal tears under pressure, i.e., the maximum tensile stress;

Rp 0.2: Stress at which the metal undergoes a 0.2% non-proportional (permanent) extension during a tensile test;

Elongation: the maximum elongation at break.

After annealing or after annealing and blow forming, the preforms were subjected to a test for hardness. The Vickers Hardness (MPa) was measured in various sections over the height of the annealed preforms, and of the annealed and blow formed preforms. The Vickers hardness was measured according to NF ISO 6507-1. The results were as follows in TABLE II:

TABLE II

TEST RESULTS - HARDNESS

| Height from base (mm) | Annealed | Annealed and blow formed |
|---|---|---|
| 170 | 53.0 | 52.8 |
| 130 | 51.8 | 51.4 |
| 90 | 51.8 | 74.8 |
| 50 | 53.5 | 60.0 |
| 15 | 52.6 | 70.9 |
| 0 | 47.8 | 58.3 |

The sections at a height of 170 mm and 130 mm were sections subjected to a necking operation and were not subjected to blow forming. The sections at 90 mm and 15 mm were sections that had been subjected to blow forming. The section at 50 mm substantially retained the original diameter and was not, or to a minor extent, subject to blow forming. The hardness results given in TABLE II above, show that the blow forming, which is a form of work hardening, resulted in an increased hardness.

Figure 14:
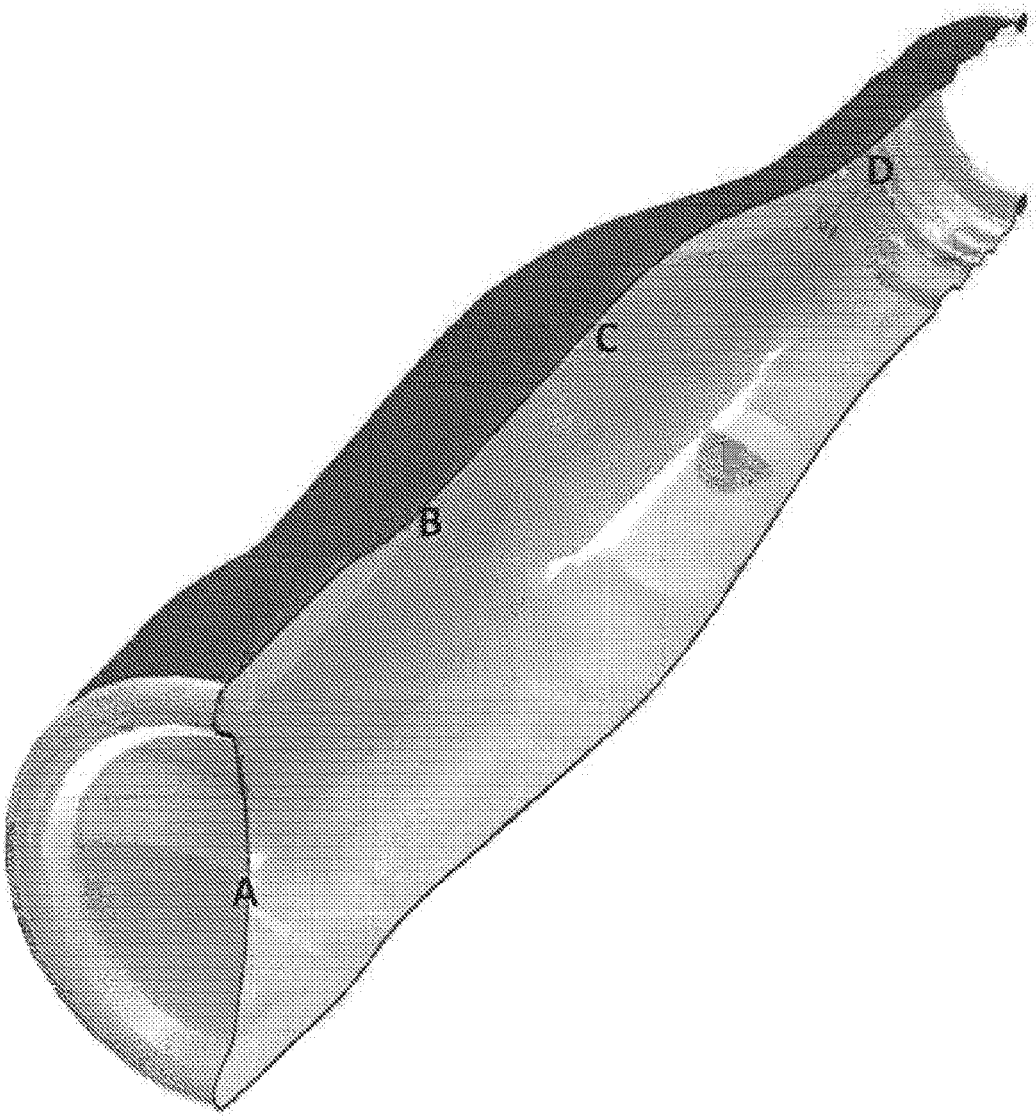
FIG. 14 is an illustration that depicts an illustrative cross-section of metal container formed from annealing and shaping a cylindrical metal preform utilizing the principles of the present invention.

FIG. 14 is an illustration that depicts an illustrative metal container formed from annealing and shaping a cylindrical metal preform utilizing the principles of the present invention. The metal container includes four portions identified as A (base), B (lower middle), C (upper middle), and D (neck) at which different amounts of work hardening is performed. The effect of annealing, blow forming, and necking on the grain structure of the metal was studied. The grain structure was determined by performing standard surface etching and visual inspection via microscopy. Preform samples were cut from the preform in a longitudinal cross-sectional manner across the thickness of the preform. The preform samples were mounted in resin, and after polishing and etching of the cutting surface, photographs were taken (at magnification to scale).

FIGS. 15A and 15B, 16A and 16B, 17A and 17B, and 18A and 18B are companion photographs and analysis images of respective illustrative portions of the metal container of FIG.

14 that show the effects of annealing, blow forming, and die necking on grains of metal of the metal container. The preform samples were taken at various heights of preforms, as depicted in FIG. 14 at four portions A (base), B (lower middle—40 mm above base), C (upper middle—90 mm above base), and D (neck—150 mm above base). The preform samples taken from sections at the portions that were (i) not subjected to annealing (FIG. 15A), (ii) subjected to annealing and blow forming with 4% expansion (FIG. 16A), (iii) subjected to annealing and blow forming with 18% expansion (FIG. 17A), and (iv) subjected to annealing and die necking (FIG. 18A). Each of the photographs and analysis images 15A/B, 16A/B, 17A/B, and 18A/B have the same scale. The analysis images in FIGS. 15B-18B were obtained with ImageJ software processing that extracts grain outlines from the microstructure photographs in order to conduct quantitative analysis of grain size and aspect ratio.

Figure 15A:
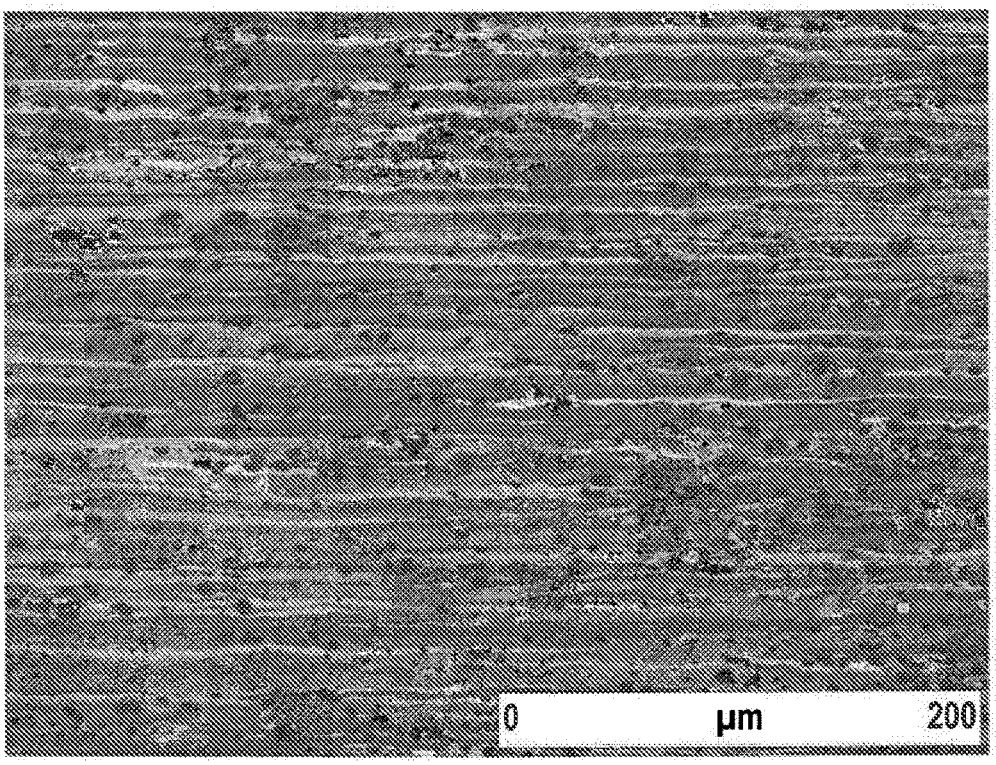
FIGS. 15A and 15B, 16A and 16B, 17A and 17B, and 18A and 18B are companion photographs and analysis images of respective illustrative portions of the metal container of FIG. 14 that show the effects of annealing, blow forming, and die necking on grains of metal of the metal container.
Figure 15B:
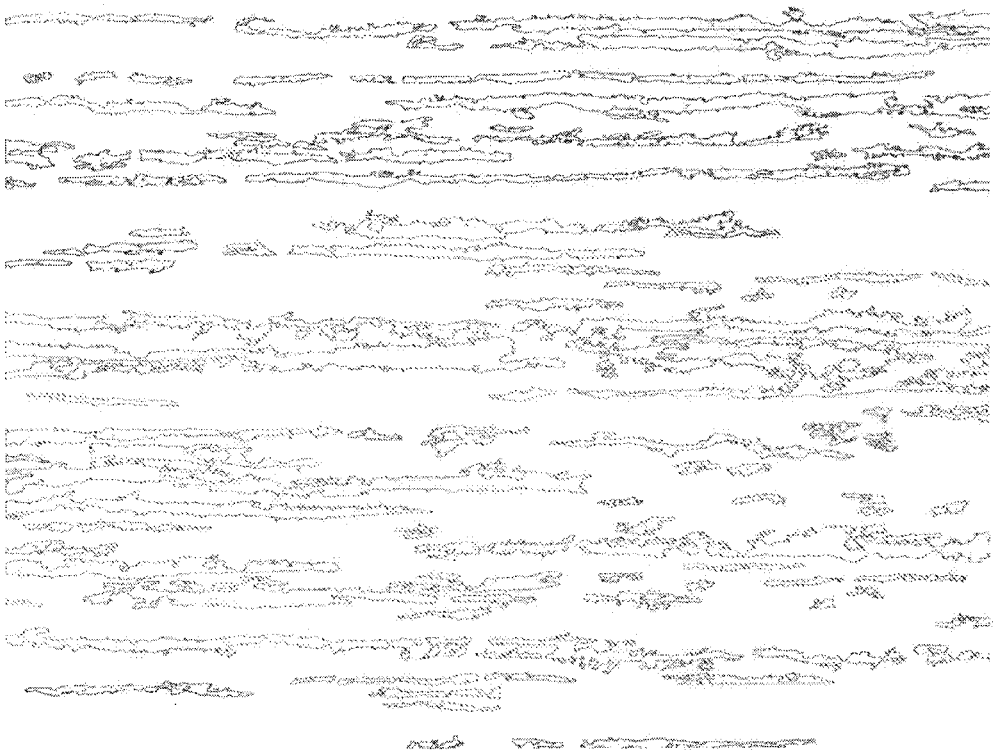

FIGS. 15A and 15B (collectively FIG. 15) are an illustrative photograph and analysis image, respectively, that illustrate the grain structure at a base (FIG. 14, portion A) of a shaped metal container. The base, in this embodiment, is not annealed or blow formed and has a grain structure that flat, "pancake"-like, elongated, and aligned in its orientation. FIG. 15B is an analysis image in which the grain structure is outlined to provide for computer analysis to determine an average aspect ratio of the grains in the portion being sampled. The grains extend two-directionally across the base. In this embodiment, the grain has an average width of 55.70 microns, height of 7.45 microns, and aspect ratio of 7.03. It is noted that the algorithm is to calculate the aspect ratio of each individual grain first, then average over the aspect ratios of all the grains calculated. Therefore the average aspect ratio is not simply average width divided by the average height.

Figure 16A:
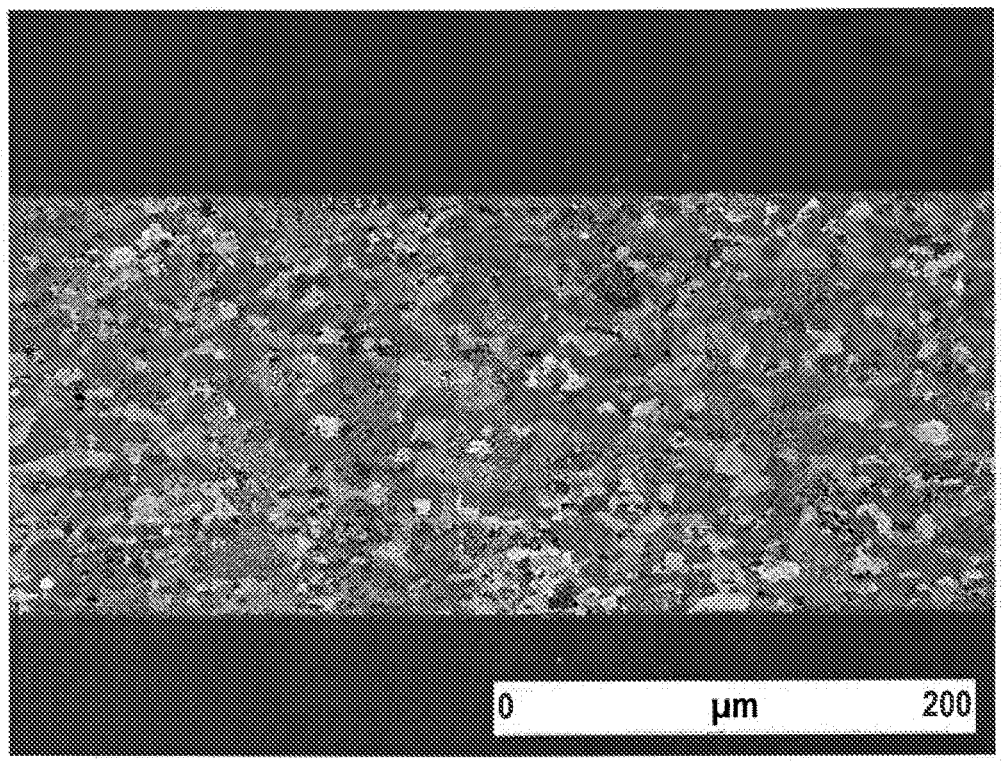
Figure 16B:
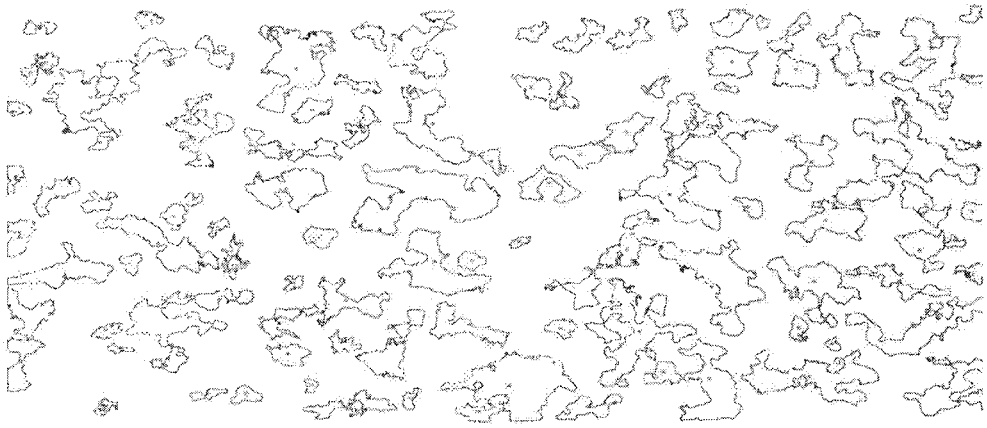

FIGS. 16A and 16B (collectively FIG. 16) are an illustrative photograph and analysis image, respectively, that illustrate the grain structure at a lower middle section (FIG. 14, portion B) of a shaped metal container. The grains at this section are annealed and expanded 4%. The grains are shown to be randomized (i.e., no longer "pancake"-like and aligned in orientation). In this embodiment, the grain has an average width of 23.91 microns, average height of 16.70 microns, and average aspect ratio of 1.54.

Figure 17A:
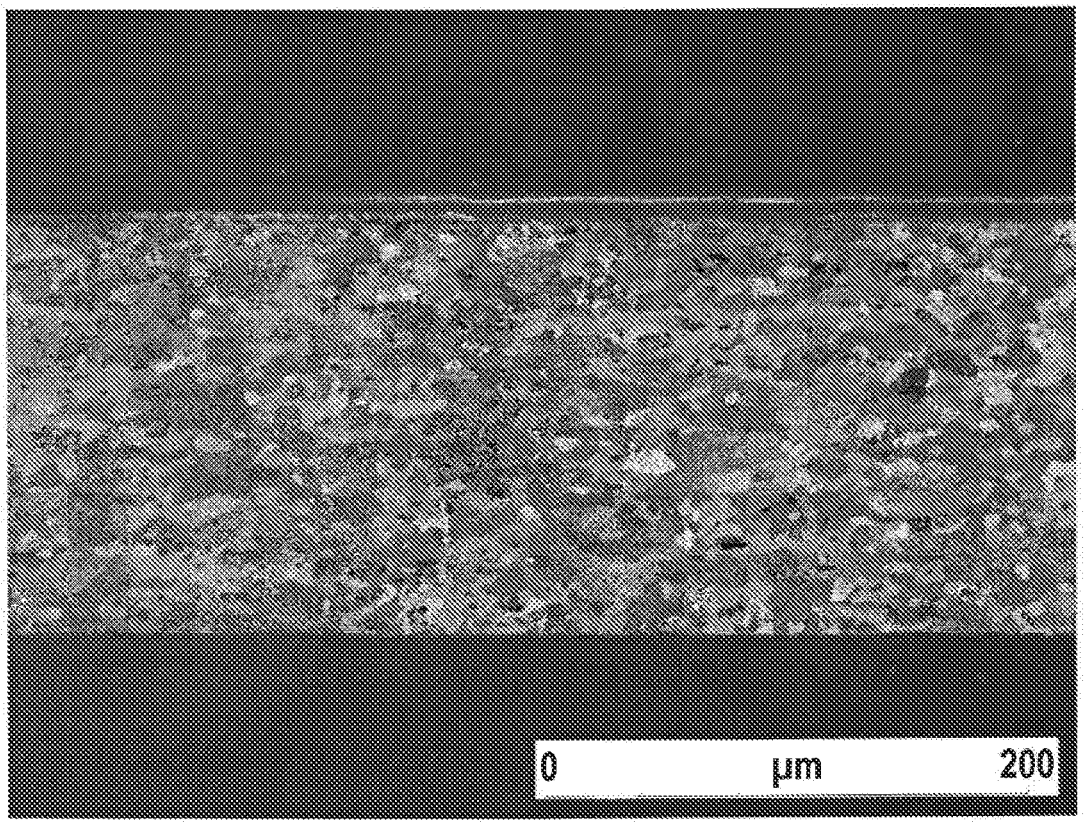
Figure 17B:
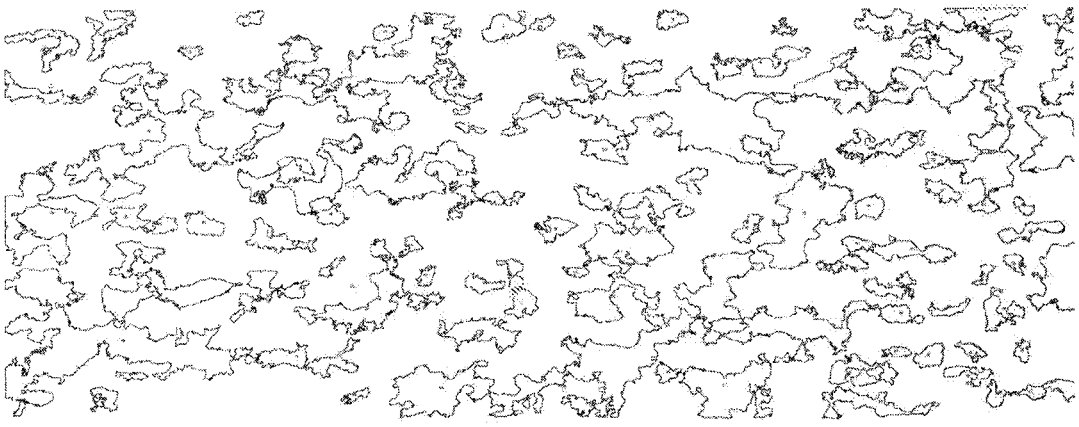
Figure 18A:
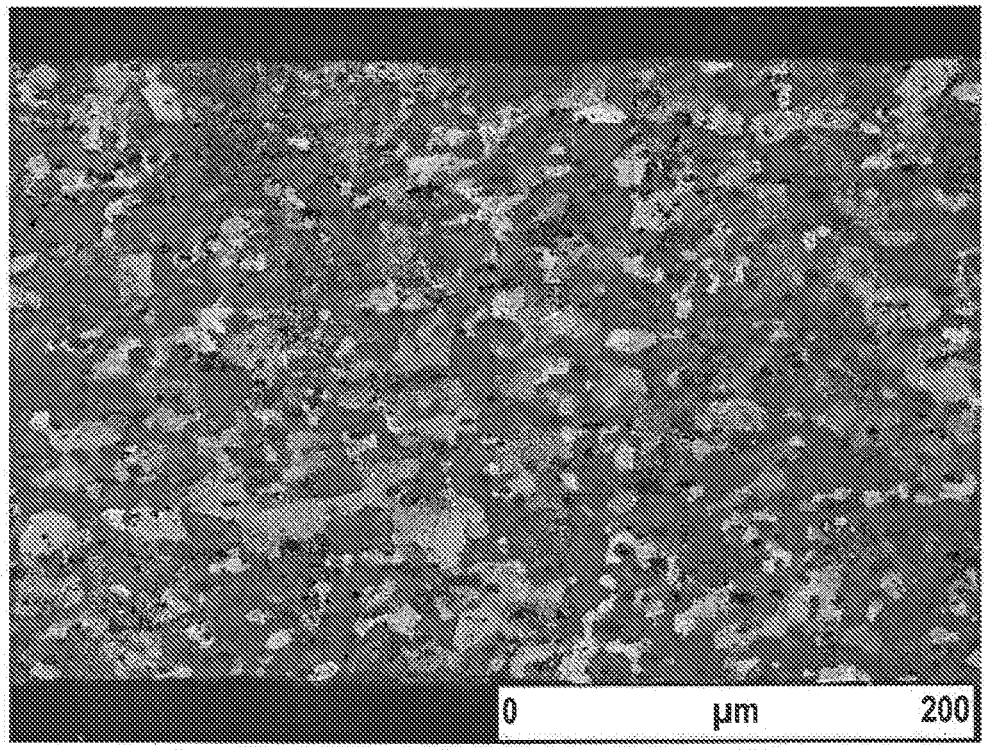

FIGS. 17A and 17B (collectively FIG. 17) are an illustrative photograph and analysis image, respectively, that illustrate the grain structure at an upper middle section (FIG. 14, portion C) of a shaped metal container. The grains at this section are annealed and expanded 18%. The grains are shown to be randomized (i.e., no longer "pancake"-like and aligned in orientation). In this embodiment, the grain has an average width of 25.55 microns, average height of 15.89 microns, and average aspect ratio of 1.71.

Figure 18B:
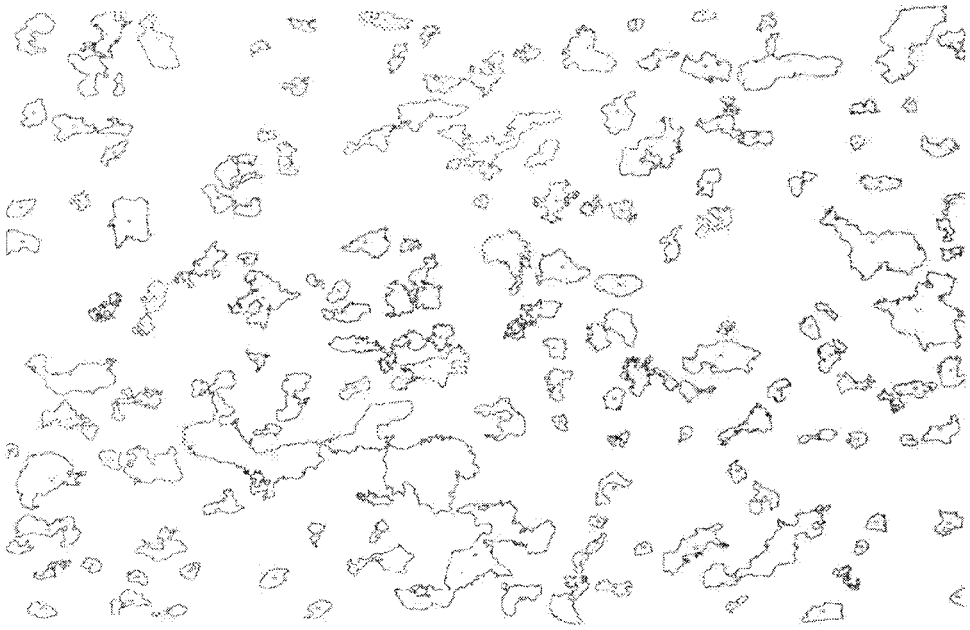

FIGS. 18A and 18B (collectively FIG. 18) are an illustrative photograph and analysis image, respectively, that illustrate the grain structure at a neck section (FIG. 14, region D) of a shaped metal container. The grains at this section are annealed die necked. The grains are shown to be randomized (i.e., no longer "pancake"-like and aligned in orientation). In this embodiment, the grain has an average width of 18.64 microns, average height of 14.10 microns, and average aspect ratio of 1.36.

The effects in relation to the change in grain structure may be explained in that the flat, "pancake"-like grain structure is asymmetrical and two-directional, so that the properties are different in both directions. The rounded grain structure is symmetrical and omni-directional, so that the properties are more uniform in any direction. The flat, "pancake"-like grains extend parallel to the rolling direction, and are therefore prone to splitting during necking or flanging. Moreover, the structure includes undue stress. The rounded grain structure is far less prone to splitting during necking and flanging. Because the grains extend more omni-directional, the structure includes less stresses and is thus more formable.

As indicated hereinbefore, in the making of a shaped metal container provided with a container bottom section, container middle section, and container top section that have different diameters larger, equal, and smaller than the preform diameter Dc, conflicting shape making conditions exist. Because in the making of such shaped metal container the sections or section parts having a diameter larger than the diameter Dc should be less hard such as a lower yield strength, and a high ductility and elongation at break, whereas sections or section parts that have a diameter smaller than Dc and produced by necking use a relatively high strength or hardness. Above that, situations have been described in which the preforms may be first subjected to necking and subsequently other parts subjected to blow forming. These conflicts of manufacturing processes may be overcome or surpassed by utilizing the principles of the present invention inclusive of inward shaping and outward shaping, where the outward shaping is performed after annealing treatment to enable greater expansion of the annealed preform.

It will be obvious to the skilled person that the method for making the shaped metal container makes use of various techniques already existing in the container making process. Accordingly, the processes described herein can be easily incorporated in existing container producing lines.

The annealing process provides for an elegant form of outwardly shaping, particularly by to incorporate aesthetic and ornamental designs, such as logos, may be carried out in an oven that is relatively slow or by induction that is relatively fast. Induction annealing or annealing provides the further advantage of locally fast annealing or annealing a section or part of the section of the preform. In addition, it is possible to first have the preform annealed in an oven as a whole, and after a blow forming step, a further annealing process may be carried out in a particular section or section part where after that part is further subjected to a blow forming step as desired or dictated by the desired shape or form of the shaped metal container. The annealing results in the reduction of the hardness, in particular of the yield strength, whereas the elongation at break is increased, such as to 10-25%, more particularly 15-20%, such as 18-20%.

The shaped metal container is generally produced from a metal, such as aluminum or steel, or from alloys, which may have a particular temper. It is also possible to use combinations of metal with plastics and with glass.

Finally, although not described in detail, in making the shaped metal container, it is also possible to make a shaped metal container that does not have a circular cross-section, but may have a non-circular cross section, such as an oval, ellipse, or any other geometrical or non-geometrical shaped cross-section.

Although particular embodiments of the present invention have been explained in detail, it should be understood that various changes, substitutions, and alterations can be made to such embodiments without departing from the scope of the present invention as defined by the following claims.

What is claimed:

1. A method for making a shaped metal container, the container including a container middle section having at least one middle section diameter Dm, the container middle section being connected at one end to a container bottom section having at least one bottom section diameter Db, and at the other end connected to a container top section having a container opening, and having at least one top section diameter Dt, the method comprising:

providing a container preform having a cylindrical body with a diameter Dc;

inwardly shaping by necking at least a section of the cylindrical body;

annealing at least a section to be inwardly or outwardly shaped, wherein annealing is performed such that at least a section has a rounded grain structure with an average aspect ratio in the range of less than 4 to 1, wherein the rounded grain structure is created by the annealing;

outwardly shaping at least a section of the cylindrical body;

wherein at least one of the middle section diameter Dm, the bottom section diameter Db, and the top section diameter Dt is greater than the cylinder diameter Dc of the container preform; and wherein at least one of the middle section diameter Dm, the bottom section diameter Db, and the top section diameter Dt, is smaller than the cylinder diameter Dc of the container preform.

2. The method according to claim 1, wherein annealing at least a section causes a rounded grain structure with an average aspect ratio in the range of less than 2 to 1.

3. The method according to claim 1, wherein outwardly shaping is performed by blow forming.

4. The method according to claim 1, further comprising applying an axial compression onto the container preform during the blow forming.

5. The method according to claim 1, wherein annealing is performed by induction annealing before outwardly shaping.

6. The method according to claim 1, further comprising forming the container top section by necking.

7. The method according to claim 1, further comprising forming a thread and/or a bead in the necked top section, and at least one of the thread and bead includes at least one axial interruption.

8. The method according to claim 1, wherein after necking or outwardly shaping the container top section, the method further comprises trimming, and curling the container opening.

9. The method according to claim 1, wherein the container middle section is provided with inwardly and/or outwardly extending strengthening or aesthetic structures.

10. The method according to claim 1, wherein the shaped metal container is a one-piece container.

11. The method according to claim 10, wherein the one-piece container is a metal beverage bottle.

12. The method according to claim 10, wherein the one-piece container is a metal aerosol container.

13. The method according to claim 1, wherein the container comprises a base that is connected to the container bottom section, wherein the base is not annealed.

* * * * *